US012721489B2

(12) United States Patent
Kozlowski, Jr. et al.

(10) Patent No.: US 12,721,489 B2
(45) Date of Patent: Sep. 1, 2026

(54) VACUUM CLEANER

(71) Applicant: Techtronic Floor Care Technology Limited, Tortola (VG)

(72) Inventors: William Jacob Kozlowski, Jr., Monroe, NC (US); Siddharth Mahajan, Concord, NC (US); Manish Shastrakar, Charlotte, NC (US); Steven W. Kegg, Hickory, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 18/869,418

(22) PCT Filed: May 25, 2023

(86) PCT No.: PCT/US2023/067452

§ 371 (c)(1),
(2) Date: Nov. 26, 2024

(87) PCT Pub. No.: WO2023/235671

PCT Pub. Date: Dec. 7, 2023

(65) Prior Publication Data

US 2025/0107679 A1 Apr. 3, 2025

Related U.S. Application Data

(60) Provisional application No. 63/347,628, filed on Jun. 1, 2022.

(51) Int. Cl.

| | |
|---|---|
| ***A47L 9/16*** | (2006.01) |
| ***A47L 9/28*** | (2006.01) |
| ***A47L 9/32*** | (2006.01) |

(52) U.S. Cl.

CPC ..... *A47L 9/165* (2013.01); *A47L 9/1641* (2013.01); *A47L 9/1666* (2013.01); *A47L 9/2884* (2013.01); *A47L 9/322* (2013.01)

(58) Field of Classification Search

CPC .... A47L 9/1658; A47L 9/1666; A47L 9/1608; A47L 9/0081; A47L 9/165; A47L 9/102;

(Continued)

(56) References Cited

U.S. PATENT DOCUMENTS

| | | | |
|---|---|---|---|
| 4,665,581 | A | 5/1987 | Oberdorfer |
| 5,720,074 | A | 2/1998 | Lee |

(Continued)

FOREIGN PATENT DOCUMENTS

| | | | |
|---|---|---|---|
| CN | 100556352 | C | 11/2009 |
| CN | 102525334 | A | 7/2012 |

(Continued)

OTHER PUBLICATIONS

PE2E Translation CN 106618375; Hand-held Dust Collector; Lu, Dong-liang; Dec. 4, 2020 (Year: 2020).*

(Continued)

*Primary Examiner* — Brian D Keller
*Assistant Examiner* — Sidney D Full
(74) *Attorney, Agent, or Firm* — Michael Best & Friedrich LLP

(57) ABSTRACT

A vacuum cleaner includes a body, a suction source disposed in the body, a separator, and a post-motor filter. The body extends along a longitudinal axis between a front end and a rear end. A fluid flow path extends from a suction inlet to an air outlet. The suction source is configured to draw air and debris through the suction inlet along the fluid flow path. The suction source has a suction source inlet and a suction source outlet. The post-motor filter is disposed in the fluid flow path between the suction source outlet and the air outlet. The post-motor filter forms an aperture extending along the longitudinal axis. The post-motor filter is forward of the suction source. A first passageway extends from the sepa- (Continued)

rator to the suction source inlet. The first passageway extends through the aperture of the post-motor filter.

62 Claims, 18 Drawing Sheets

(58) Field of Classification Search
CPC ..... A47L 9/127; A47L 9/16; A47L 9/1616; A47L 9/1641; A47L 9/10–1691; A47L 9/2884; A47L 5/24; A47L 5/32; A47L 5/365; A47L 11/4097
See application file for complete search history.

(56) References Cited

U.S. PATENT DOCUMENTS

| | | | | |
|---|---|---|---|---|
| 6,341,404 | B1 * | 1/2002 | Salo | A47L 5/28 15/352 |
| 6,532,621 | B2 * | 3/2003 | Stephens | A47L 5/28 15/350 |
| 6,948,211 | B2 | 9/2005 | Stephens et al. | |
| 7,114,216 | B2 | 10/2006 | Stephens et al. | |
| 7,610,654 | B2 | 11/2009 | Lee et al. | |
| 7,627,929 | B2 | 12/2009 | Stephens et al. | |
| 7,690,077 | B2 | 4/2010 | Biere | |
| 7,900,317 | B2 | 3/2011 | Stephens et al. | |
| 8,695,161 | B2 | 4/2014 | Williams | |
| 8,739,358 | B2 | 6/2014 | Stephens et al. | |
| 9,402,516 | B2 * | 8/2016 | Pilch | A47L 9/325 |
| 9,451,855 | B2 | 9/2016 | Conrad | |
| 9,818,392 | B2 | 11/2017 | Hwang et al. | |
| 10,165,914 | B2 | 1/2019 | Conrad et al. | |
| 11,033,163 | B2 | 6/2021 | Sakuma et al. | |
| 11,116,369 | B2 | 9/2021 | Keller | |
| 11,889,969 | B2 | 2/2024 | Conrad | |
| 2007/0020020 | A1 | 1/2007 | Bobrosky et al. | |
| 2010/0199455 | A1 | 8/2010 | Vrdoljak | |
| 2010/0236018 | A1 | 9/2010 | Vrdoljak et al. | |
| 2014/0201943 | A1 | 7/2014 | Williams | |
| 2017/0196421 | A1 | 7/2017 | Brown et al. | |
| 2017/0280951 | A1 | 10/2017 | Nam et al. | |
| 2018/0110384 | A1 | 4/2018 | Sakuma et al. | |
| 2019/0069737 | A1 | 3/2019 | Sakuma et al. | |
| 2019/0069741 | A1 | 3/2019 | Murakami et al. | |
| 2019/0335965 | A1 * | 11/2019 | Yang | A47L 9/22 |
| 2020/0205625 | A1 | 7/2020 | Li et al. | |
| 2020/0245833 | A1 | 8/2020 | Lee et al. | |
| 2022/0151446 | A1 * | 5/2022 | Conrad | A47L 9/1666 |
| 2023/0015783 | A1 * | 1/2023 | Conrad | A47L 9/1666 |
| 2023/0301478 | A1 * | 9/2023 | Escalettes | B01D 46/0043 |
| 2024/0032745 | A1 | 2/2024 | Jonsson et al. | |
| 2024/0041279 | A1 * | 2/2024 | Conrad | A47L 9/1625 |
| 2025/0127350 | A1 * | 4/2025 | Conrad | A47L 5/28 |

FOREIGN PATENT DOCUMENTS

| | | | | | |
|---|---|---|---|---|---|
| CN | 107744366 | A | | 3/2018 | |
| CN | 109832997 | A | | 6/2019 | |
| CN | 208957956 | U | | 6/2019 | |
| CN | 209269536 | U | | 8/2019 | |
| CN | 209269542 | U | | 8/2019 | |
| CN | 209285352 | U | | 8/2019 | |
| CN | 209285354 | U | | 8/2019 | |
| CN | 110754995 | A | * | 2/2020 | A47L 9/0081 |
| CN | 211066394 | U | | 7/2020 | |
| CN | 211511618 | U | | 9/2020 | |
| CN | 211559912 | U | | 9/2020 | |
| CN | 106618375 | B | * | 12/2020 | A47L 5/24 |
| CN | 214317923 | U | | 10/2021 | |
| CN | 214433967 | U | | 10/2021 | |
| EP | 1559359 | A2 | | 8/2005 | |
| EP | 1579797 | A1 | | 9/2005 | |
| EP | 1795107 | A2 | | 6/2007 | |
| EP | 3906829 | A1 | | 11/2021 | |
| WO | 2014166342 | A1 | | 10/2014 | |
| WO | 2017092832 | A1 | | 6/2017 | |
| WO | 2020108492 | A1 | | 6/2020 | |

OTHER PUBLICATIONS

CN-110754995 PE2E Translation; Exhaust Device and the Dust Collector; Li, Jin-kun; Feb. 7, 2020 (Year: 2020).*

International Search Report and Written Opinion for Application No. PCT/US2023/067452 dated Sep. 14, 2023 (13 pages).

* cited by examiner

VACUUM CLEANER

CROSS REFERENCE TO RELATED APPLICATIONS

This application claims priority to U.S. Provisional Patent Application No. 63/347,628, filed Jun. 1, 2022, the entire contents of which are hereby incorporated by reference herein.

BACKGROUND

The present disclosure relates to an airpath through a suction unit of a vacuum cleaner.

SUMMARY

In one embodiment, a vacuum cleaner includes a body, a suction source, a separator, and a post-motor filter. The body extends along a longitudinal axis between a front end and a rear end. The longitudinal axis defines forward and rearward directions. A suction inlet is adjacent a front end. A fluid flow path extends from the suction inlet to an air outlet. The suction source is disposed in the body and operable to generate an airflow along the fluid flow path. The suction source is configured to draw air and debris through the suction inlet. The suction source has a suction source inlet and a suction source outlet. The separator is disposed in the fluid flow path between the suction inlet and the suction source inlet. The separator is configured to separate debris from the air drawn through the suction inlet. The post-motor filter is disposed in the fluid flow path between the suction source outlet and the air outlet. The post-motor filter includes an aperture. The post-motor filter is forward of the suction source. A first passageway extends from the separator to the suction source inlet. The first passageway extends through the aperture of the post-motor filter.

In a further aspect, the vacuum cleaner may include a second passageway formed between a suction source and a housing surrounding the suction source. The housing is divided into a first chamber and a second chamber connected by a chamber outlet. The suction source outlet is disposed in the housing and is configured to direct air in the second passageway in a first airflow path and a second airflow path. The first airflow path extends circumferentially around the suction source in a first direction to the chamber outlet. The second airflow path extends circumferentially around the suction source in a second direction to the chamber outlet. The suction source outlet and the chamber outlet are disposed asymmetrically such that a length of the first airflow path is different than a length of the second airflow path. The first airflow path and the second airflow path converge at the chamber outlet.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
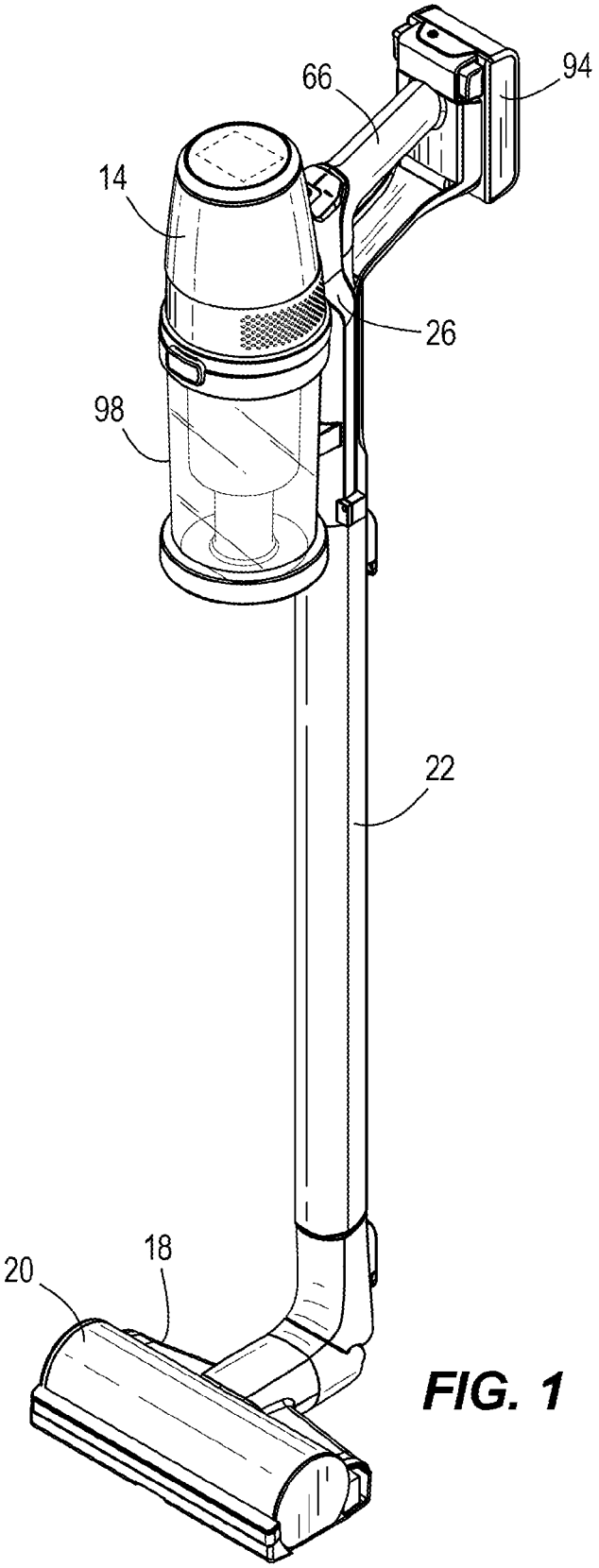
FIG. 1 is a perspective view of a vacuum cleaner coupled to a surface cleaning tool.

FIG. 1 illustrates vacuum cleaner 14 connected to a surface cleaning tool 18 by an elongate member or wand 22 forming an air path between the surface cleaning tool 18 and the vacuum cleaner 14. In the illustrated embodiment the surface cleaning tool 18 includes a floor cleaning head 20. In other embodiments, the surface cleaning tool 18 may include suction nozzles, brush members, crevice tools, and other attachments. The wand 22 is removably coupled to the vacuum cleaner 14. The surface cleaning tool 18 can be removably coupled to an end of the wand 22 or directly to the vacuum cleaner 14. The vacuum cleaner 14 can also be operated on its own without the surface cleaning tool 18 (FIG. 2).

Figure 2:
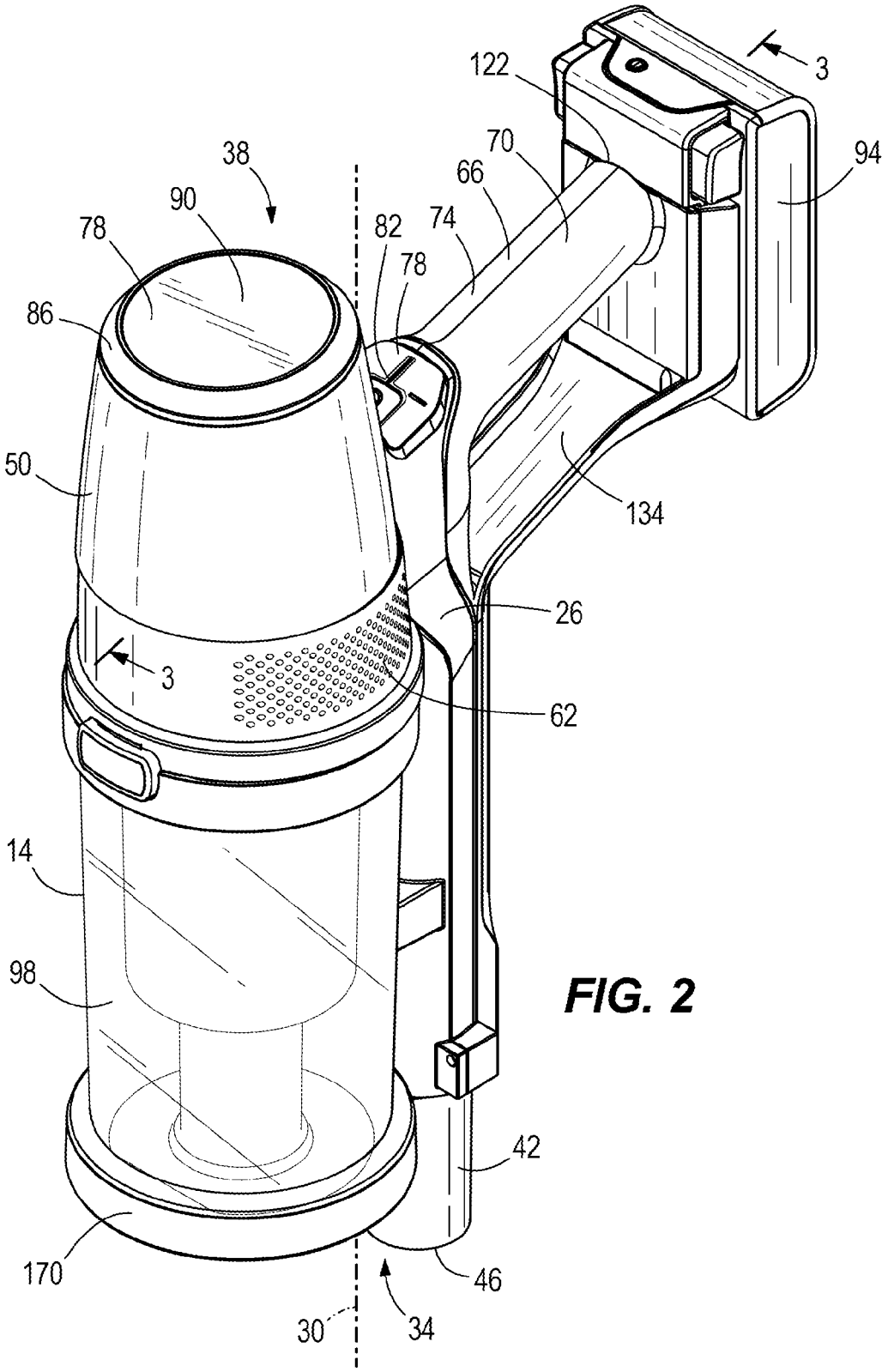
FIG. 2 is a perspective view of the vacuum cleaner of FIG. 1.

As shown in FIG. 2, the vacuum cleaner 14 includes a body 26 with a front end 34 and a rear end 38. A longitudinal axis 30 extends between the front end 34 and the rear end 38. The body 26 includes an inlet nozzle 42 having a suction inlet 46 at the front end 34. The inlet nozzle 42 is configured to removably couple to the wand 22 or the surface cleaning tool 18. The body 26 includes a housing 50 at the rear end 38. A suction source 54 (FIG. 3), operable to generate an airflow along a working air path 58 (shown schematically as a series of arrows in FIG. 3), is in the housing 50 of the body 26 such that the housing 50 encloses and surrounds the suction source 54. The working air path 58 (also referred to herein as the fluid flow path 58) extends between the suction inlet 46 and an air outlet 62 on the body 26. The suction source 54 draws debris-laden air through the suction inlet 46, and exhausts cleaned air to the environment through the air outlet 62.

The body 26 includes a handle 66 having a grip portion 70 for receiving a user's hand to support and move the vacuum cleaner 14 above a surface to be cleaned. The handle 66 may be a pistol-grip style handle. The handle 66 includes a first end 74 disposed adjacent the housing 50. The rear end 38 of the vacuum cleaner 14 includes a user interface 78. The user interface 78 includes one or more input buttons 82 on the body 26 adjacent the first end 74 of the handle 66. The housing 50 includes a rearward surface 86. In the illustrated embodiment, a portion of the user interface 78 is connected to the rearward surface 86. The user interface 78 includes a display 90 on the rearward surface 86 of the housing 50. In some embodiments the display 90 is a touch screen display and allows for input by a user.

With continued reference to FIG. 2, a battery 94 is coupled to the body 26 adjacent the handle 66. The battery 94 is operatively connected to the suction source 54. In other words, the battery 94 is in electrical communication with the suction source 54 to provide power to the suction source 54. The battery 94 may be removably coupled to the body 26. In the illustrated embodiment, the battery 94 is a rechargeable 20-volt battery. In other embodiments, other batteries may be used as compatible with the application. The body 26 may include a secondary support 134 extending along and, in some embodiments, extending parallel to the handle 66. The secondary support 134 provides additional support for the battery 94. An area 138 intended to receive a user's hand is formed between the handle 66 and the secondary support 134.

The vacuum cleaner 14 further includes a debris separator 98 removably coupled to the body 26 and positioned in the working air path 58 between the suction inlet 46 and the suction source 54. The separator 98 separates and stores the debris from the air drawn through the suction inlet 46. The separator 98 is coupled to the body 26 forward of the housing 50 and adjacent the front end 34 of the body 26.

Figure 3:
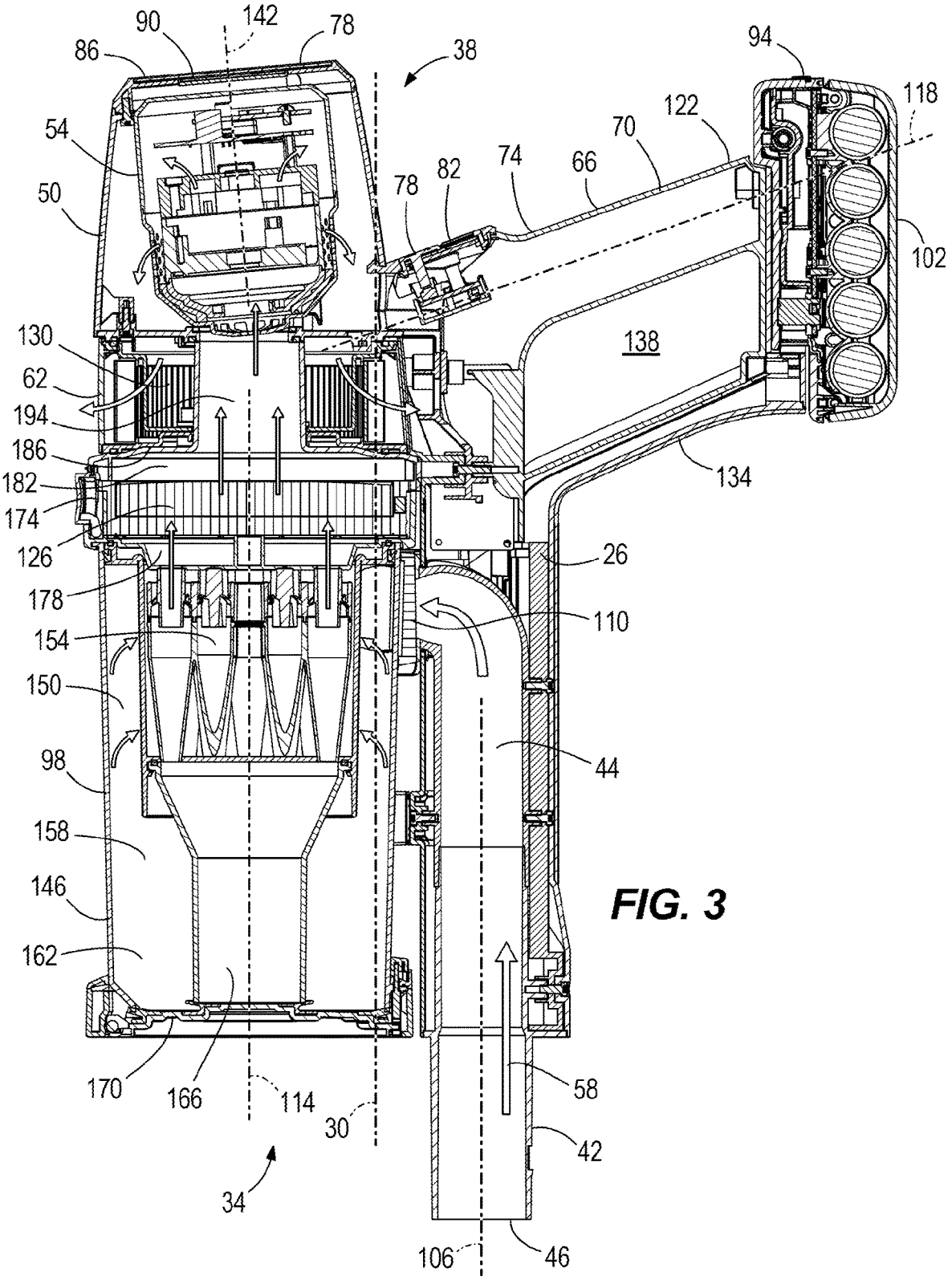
FIG. 3 is a cross-sectional view of the vacuum cleaner of FIG. 2.

With reference to FIG. 3, the battery 94 includes a bottom surface 102 that can be positioned on a horizontal surface. When the bottom surface 102 is positioned on a horizontal surface, the longitudinal axis 30 is generally horizontal. The longitudinal axis 30 defines forward and rearward directions, where forward means in a direction along the longitudinal axis 30 toward the front end 34 and rearward means in a direction along the longitudinal axis 30 toward the rear end 38.

With continued reference to FIG. 3, the inlet nozzle 42 is fluidly connected to an inlet duct 44 extending from the suction inlet 46 along an inlet axis 106 to a tangential inlet 110 in fluid communication with the separator 98. The inlet axis 106 extends generally parallel to the longitudinal axis 30. In the illustrated embodiment, the inlet axis 106 extends through the body 26 but does not intersect the handle 66. The separator 98 extends along a separator axis 114 that is generally parallel to the longitudinal axis 30 and offset from the inlet axis 106. The handle 66 extends from the first end 74 to a second end 122. The battery 94 is coupled to the body 26 adjacent the second end 122. The handle 66 forms a handle axis 118 extending through the first end 74 and the second end 122. The grip portion 70 is located between the first end 74 and the second end 122. The handle axis 118 extends through or intersects the battery 94 but does not intersect the suction source 54. Instead, the handle axis 118 passes in front of the suction source 54 such that the suction source 54 is rearward of the handle axis 118.

The vacuum cleaner 14 includes a pre-motor filter 126 positioned in the working air path 58 upstream of the suction source 54 and a post-motor filter 130 downstream of the suction source 54. The working air path 58 extend rearwardly between the pre-motor filter 126 and the suction source 54 and the working air path 58 extends forwardly between the suction source 54 and the post-motor filter 130. The pre-motor filter 126 is rearward of the separator 98 and the post-motor filter 130 is rearward of the pre-motor filter 126. The housing 50 containing the suction source 54 is positioned rearward of the post-motor filter 130 and the post-motor filter 130 is forward of the suction source 54. Stated another way, the post-motor filter 130 is between the suction source 54 and the separator 98. In the embodiment shown in FIGS. 3-9, the pre-motor filter 126 is between the post-motor filter 130 and the separator 98. In one embodiment, the separator 98, the pre-motor filter 126, and the post-motor filter 130 are all generally coaxial along the separator axis 114. The handle axis 118 extends through or intersects the post-motor filter 130. In the illustrated embodiment, the handle axis 118 intersects the separator axis 114 in the first passageway 194 between the pre-motor filter 126, and the suction source 54.

The suction source 54 is positioned in the housing 50 and extends along a suction source axis 142. The suction source 54 may be coaxial with the housing 50. In the illustrated embodiment, the suction source axis 142 is transverse to the separator axis 114 and the longitudinal axis 30. The suction source axis 142 may intersect the separator axis 114 to form an acute angle of 15 degrees or less. In other embodiments, the suction source axis 142 is parallel to the longitudinal axis 30. In still other embodiments, the suction source axis 142 is coaxial with the separator axis 114.

Figure 4:
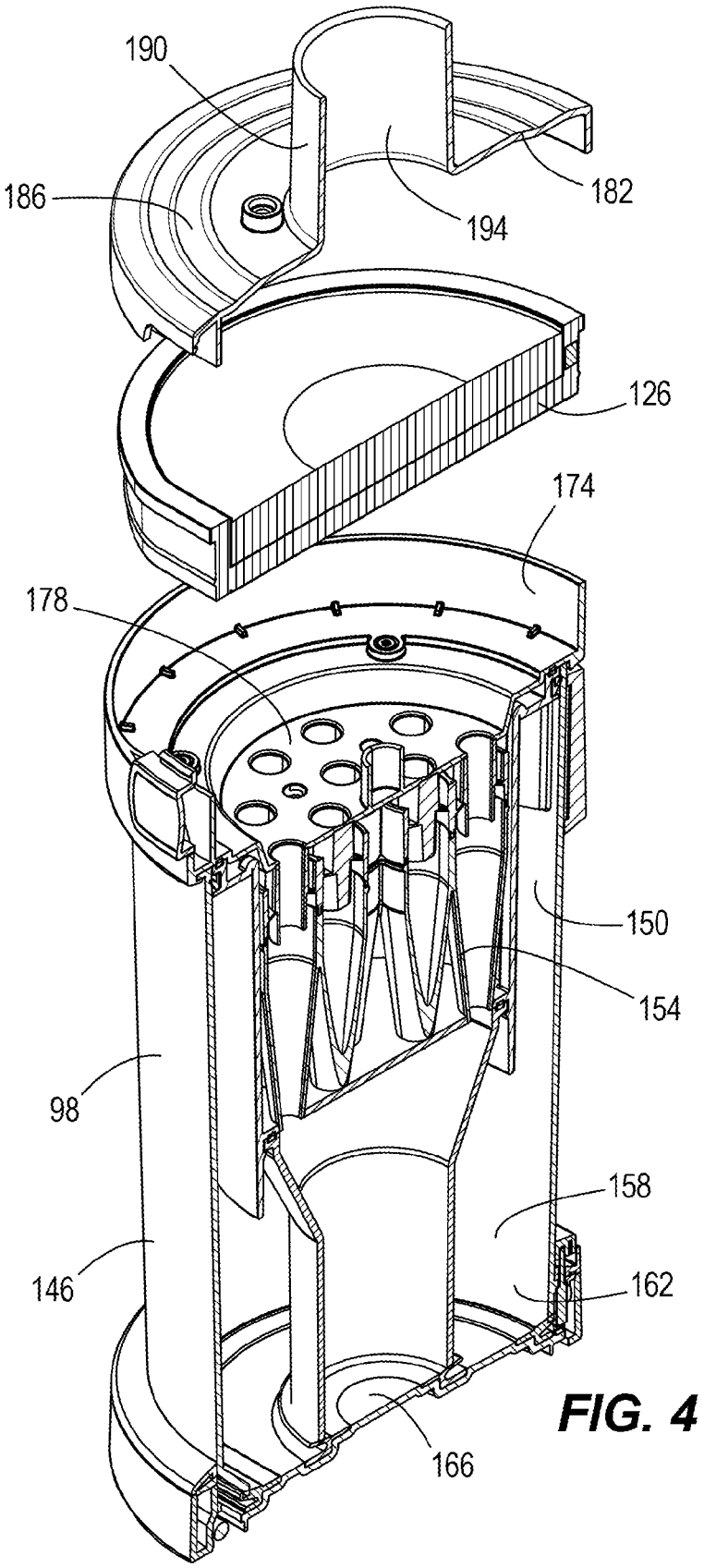
FIG. 4 is cross-sectional exploded view of a separator, a filter, and a cover of the vacuum cleaner of FIG. 2.

As illustrated in FIGS. 3 and 4, the separator 98 includes a separator housing 146. The separator housing 146 extends along the separator axis 114. In the illustrated embodiment, the separator 98 is a cyclonic separator assembly 98. In other embodiments other types of separators may be used. The cyclonic separator assembly 98 includes a first cyclonic separator 150 or first cyclone 150 and a second cyclonic separator 154 including one or more second cyclones 154. In the illustrated embodiment, the second cyclonic separator 154 includes a plurality of second cyclones 154. The first cyclone 150 and plurality of second cyclones 154 are arranged within the separator housing 146 about the separator axis 114, such that the first cyclone 150 substantially surrounds the plurality of second cyclones 154. The separator housing 146 includes the tangential inlet 110 in fluid communication with the suction inlet 46. The first cyclone 150 rotates debris-laden air about the separator axis 114 to separate debris from the air, so that the separator axis 114 is an axis of rotation. The separator 98 includes a debris storage chamber 158 defined in the separator housing 146 near a front of the separator 98. The debris storage chamber 158 is divided into a first collecting region 162, which receives debris from the first cyclone 150, and a second collecting region 166, which receives debris from the second cyclones 154. The second collecting region 166 is surrounded by the first collecting region 162. The plurality of second cyclones 154 are configured to separate fine dust from the air and deposit the fine dust in the second collecting region 166. The separator 98 also includes a cover door 170 coupled to the front of the separator housing 146. The cover door 170 is hingedly coupled to the separator housing 146 between a closed position, in which the debris storage chamber 158 is enclosed, and an open position, in which debris and fine dust from the debris storage chamber 158 can be removed. The cover door 170 opens both the first collecting region 162 and the second collecting region 166 simultaneously.

With continued reference to FIGS. 3 and 4, the separator 98 defines a pre-motor filter chamber 174 at a rear of the separator housing 146. The pre-motor filter 126 is received in the pre-motor filter chamber 174 downstream of the plurality of second cyclones 154. The pre-motor filter 126 is removable from the pre-motor filter chamber 174 for cleaning, maintenance, or replacement. The pre-motor filter chamber 174 has an upstream portion 178 in communication with the cyclonic separator assembly 98 and a downstream portion 182 in communication with the suction source 54. A cover 186, disposed rearward of the separator housing 146, forms the downstream portion 182 of the pre-motor filter chamber 174. In one embodiment, the cover 186 is releasably coupled to the separator housing 146, selectively enclosing the pre-motor filter chamber 174 so that the pre-motor filter 126 can be removed from the pre-motor filter chamber 174 when the separator 98 is uncoupled from the cover 186. The cover 186 includes an annular wall 190, extending rearwardly from the pre-motor filter chamber 174 along the separator axis 114, defining a first passageway 194 in fluid communication with the downstream portion 182 of the pre-motor filter chamber 174.

Figure 13:
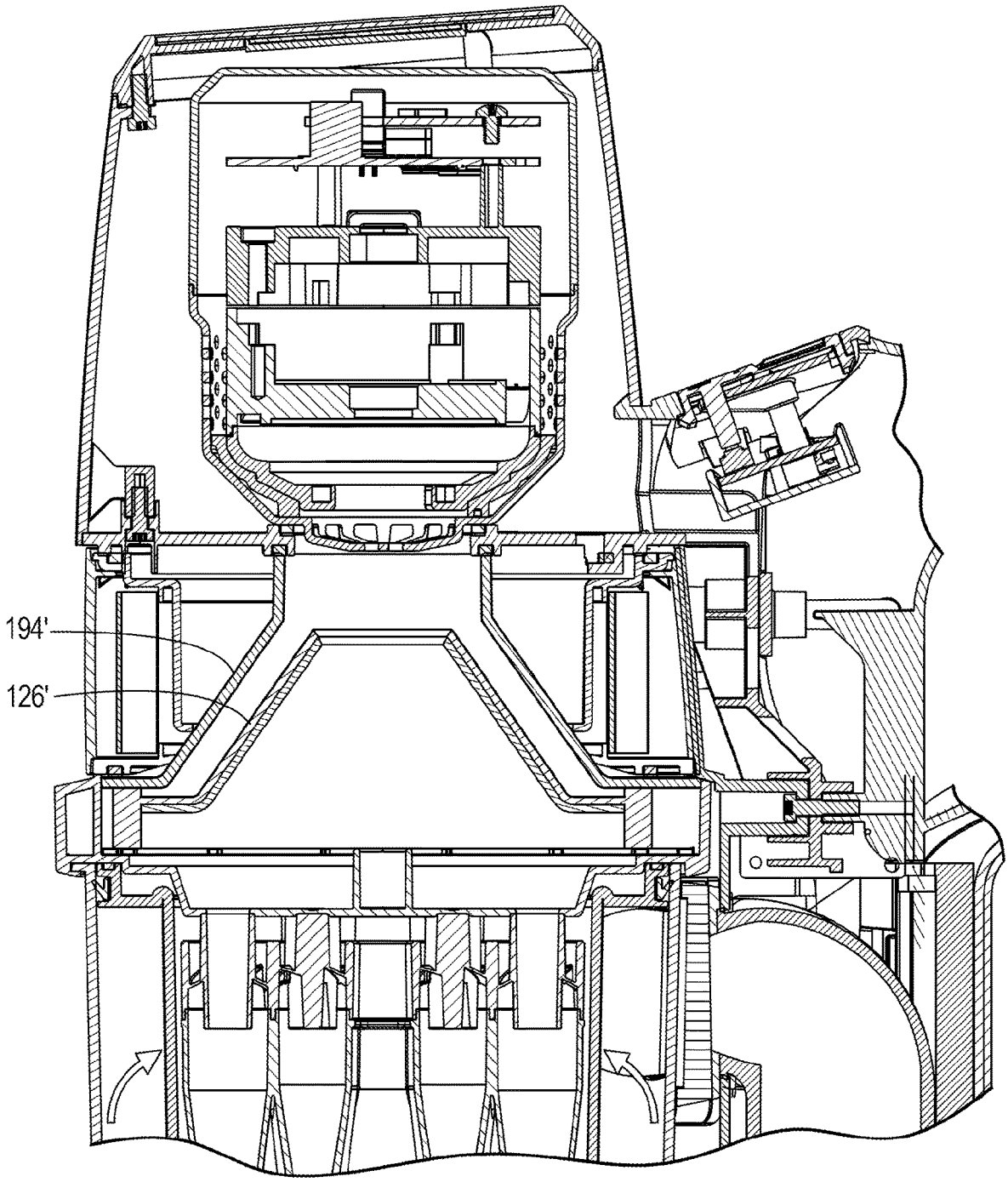
FIG. 13 illustrates a cross sectional view of another embodiment of a vacuum cleaner with a filter unit.
Figure 14:
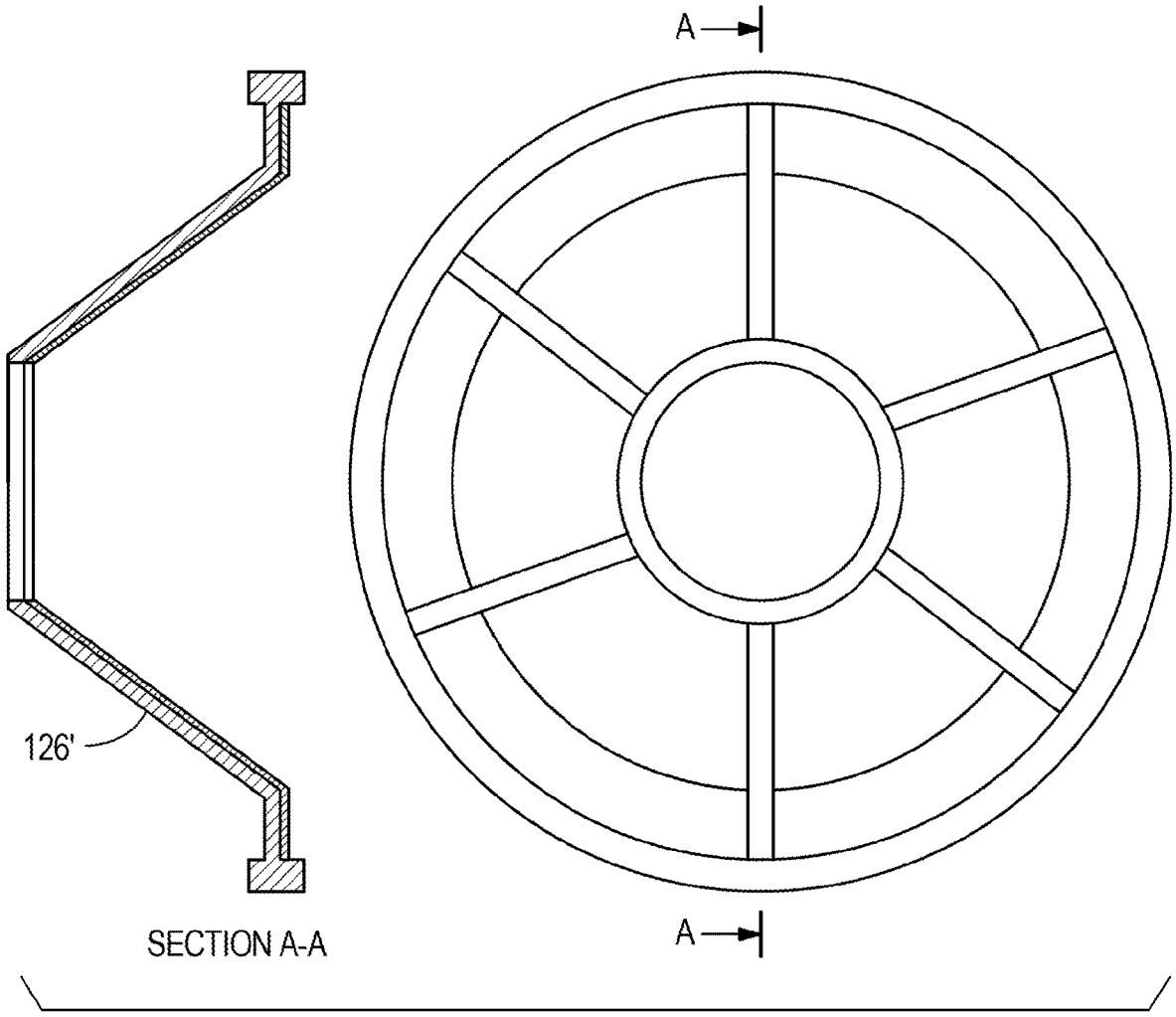
FIG. 14 illustrates detail views of the filter unit of FIG. 13.
Figure 15:
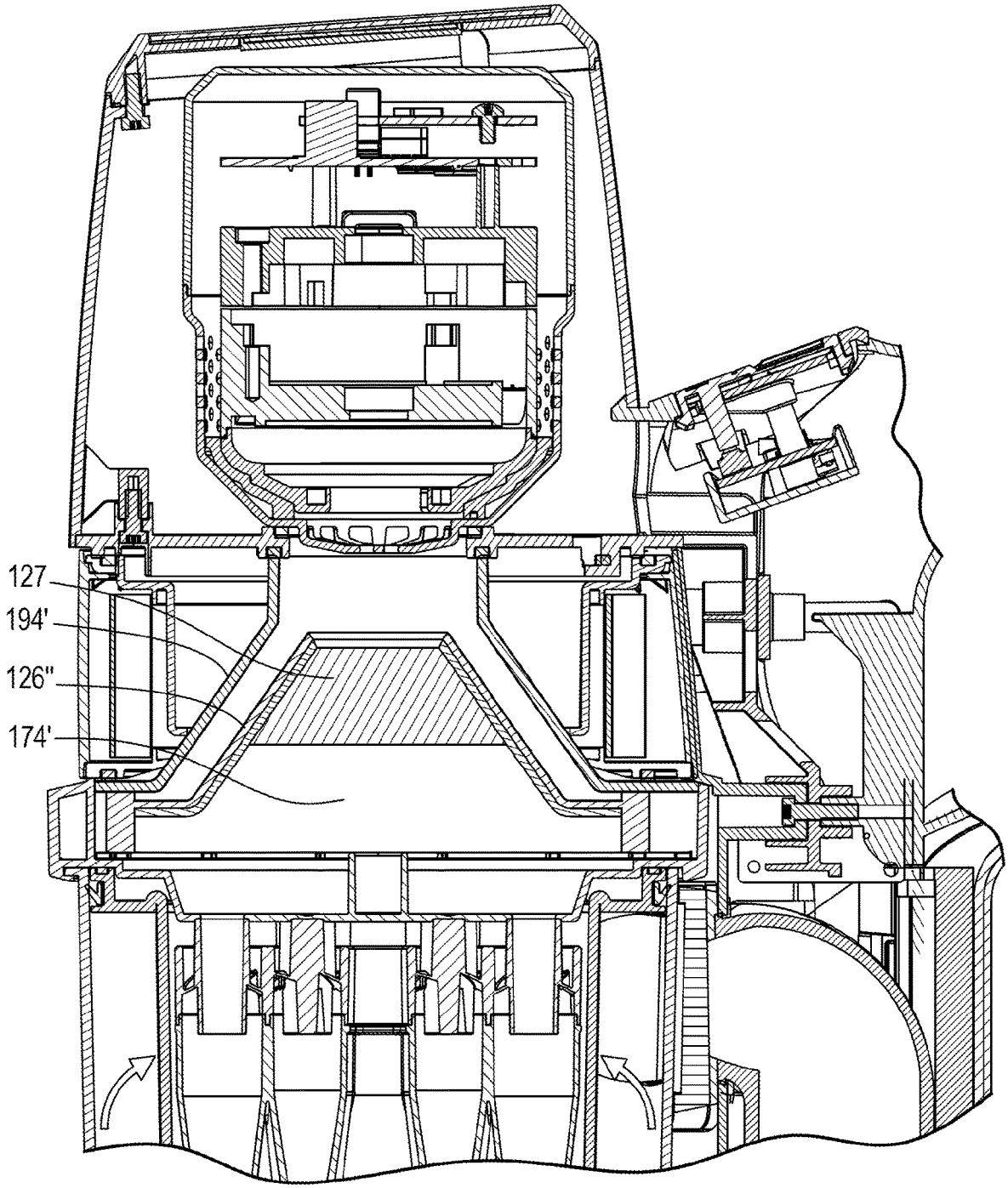
FIG. 15 illustrates a cross sectional view of another embodiment of a vacuum cleaner with another embodiment of a filter unit.
Figure 16:
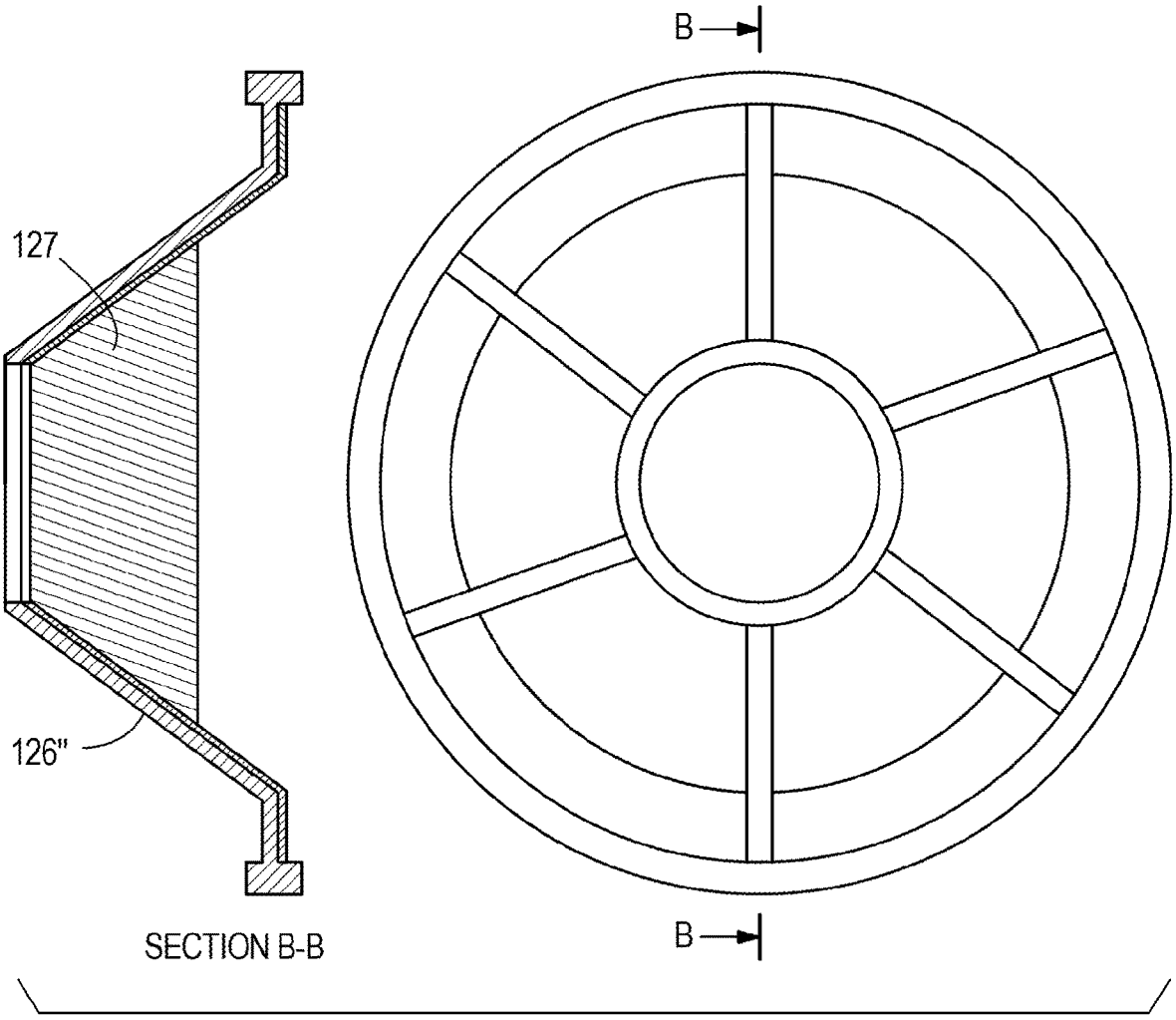
FIG. 16 illustrates detail views of the filter unit of FIG. 15.

In an alternative embodiment, shown in FIGS. 13-14, the pre-motor filter chamber 174' is disposed rearward of the separator 98. In this embodiment, the premotor filter 126' is positioned within the first passageway 194'. The illustrated premotor filter 126' includes a conical shaped filtration media. Alternatively, as shown in FIGS. 15-16, a premotor filter 126" may be provided with additional filtration media 127.

Figure 5:
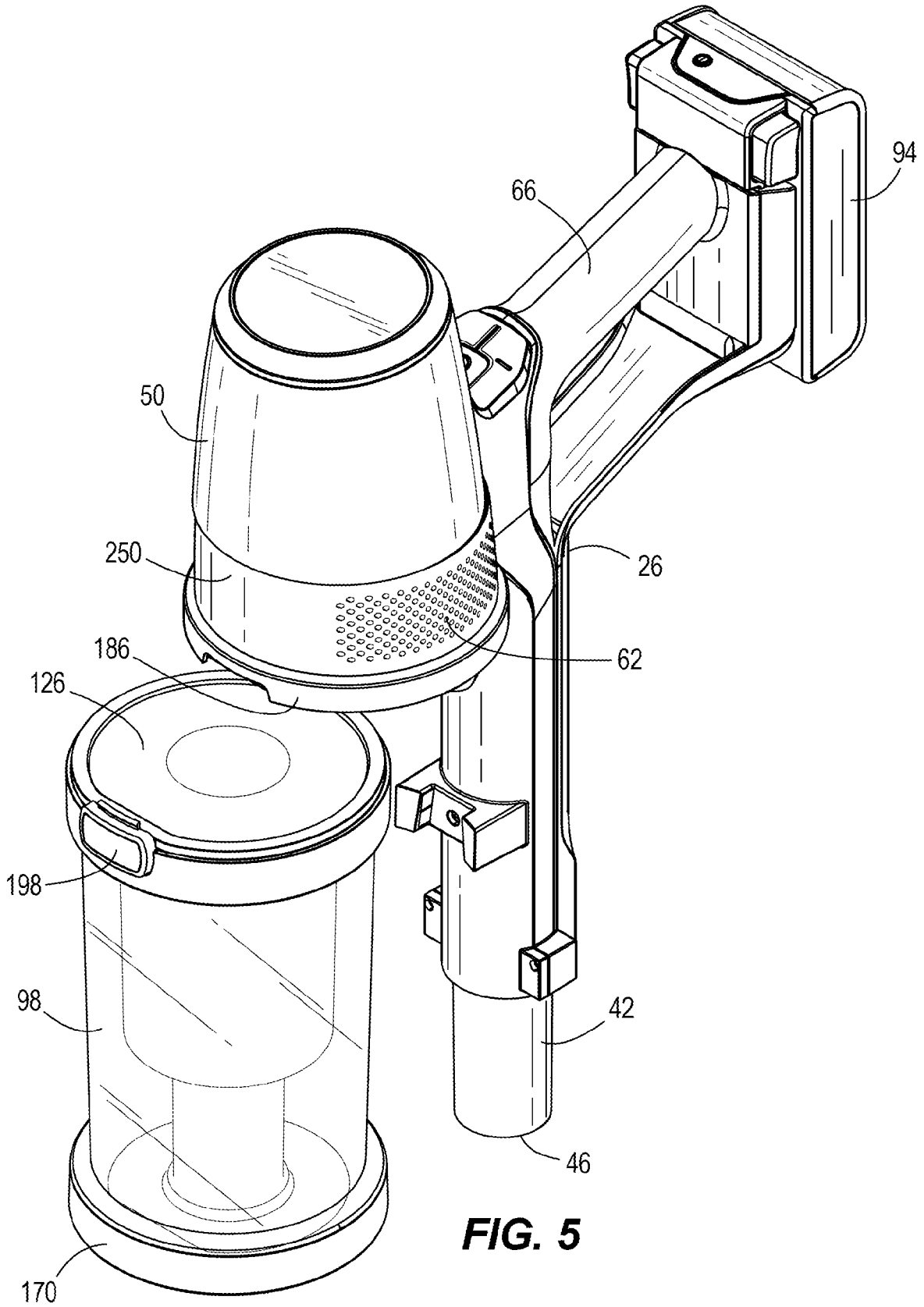
FIG. 5 is a perspective view of the vacuum cleaner of FIG. 2 with the separator uncoupled from a main body.

As shown in FIG. 5, the separator 98 is releasably coupled to the body 26 and is removable from the body 26. In some embodiments or configurations, when the separator 98 is removed from the body 26, the cover 186 remains coupled to the body 26, opening the pre-motor filter chamber 174 and allowing the pre-motor filter 126 to be removed as shown in FIG. 5. In other embodiments or configurations, the cover 186 is removed with the separator 98 so that the pre-motor filter chamber 174 remains enclosed until the cover 186 is removed from the separator 98. When the cover 186 and the separator 98 are removed from the body 26, the post-motor filter 130 is accessible and can be removed for cleaning, maintenance, or replacement. In one embodiment, the post-motor filter 130 is coupled to and removable with the cover 186, such as shown in FIG. 7B. When the cover 186 and the separator 98 are coupled to the body 26, the cover 186 closes the pre-motor filter 126 in the pre-motor filter chamber 174 and closes the post-motor filter 130 in the housing 50. In one embodiment, the cover 186 is connected to the pre-motor filter 126. In some embodiments, the separator 98 includes a latch 198 that allows a user to release the separator 98 from the body 26. In some embodiments, the separator 98 has multiple latches.

Figure 6:
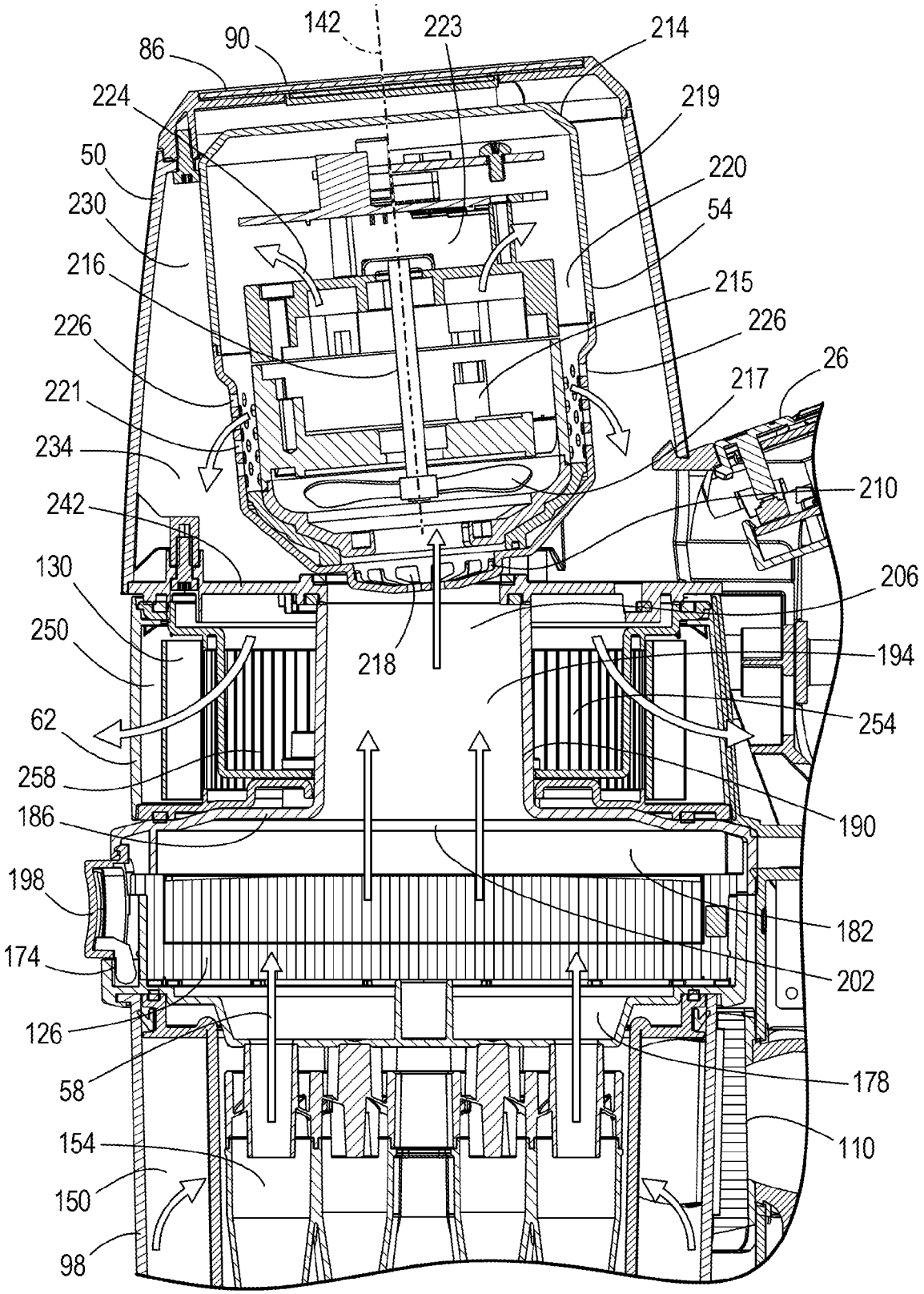
FIG. 6 is a cross-sectional view of a rear portion of the vacuum cleaner of FIG. 2.

Turning now to FIG. 6, when the cover 186 is coupled to the body 26, the first passageway 194 extends between an upstream end 202, adjacent the pre-motor filter 126, and a downstream end 206, adjacent the suction source 54. The suction source 54 extends along the suction source axis 142 between a first end 210, adjacent the first passageway 194, and a second end 214, rearward of the first end 210. The suction source 54 includes a motor 215 having a motor shaft 216 that rotates an impeller 217 (shown schematically in FIG. 6) about the suction source axis 142. The suction source 54 includes a motor housing 219 around the motor 215 forming an inner chamber 220 between the motor 215 and the motor housing 219. The inner chamber 220 forms an air passageway through the suction source 54. The motor housing 219 includes a first portion 221 near the first end 210 and a second portion 223 near the second end 214. The motor 215 includes a motor air exit 224 toward the second end 214 configured to exhaust air from the motor 215 into the second portion 223. The suction source 54 includes a suction source inlet 218 positioned adjacent the first end 210 in communication with the impeller 217. In the illustrated embodiment, the suction source inlet 218 is formed by a plurality of openings, however, in other embodiments, the suction source inlet 218 is formed as a single aperture. The suction source 54 also includes a suction source outlet 226 in motor housing 219. In the illustrated embodiment, the suction source outlet 226 is in the first portion 221 adjacent the first end 210. In the illustrated embodiment, the suction source outlet 226 is formed as plurality of apertures; however, in other embodiments, the suction source outlet 226 is formed as a single aperture. In one embodiment, the suction source outlet 226 extends circumferentially around the suction source 54. In the illustrated embodiment, the suction source 54 includes two discrete suction source outlets 226 disposed opposite one another on the motor housing 219. Each of the two discrete suction source outlets 226 are formed of a plurality of apertures. In one embodiment, the two discrete suction source outlets 226 are disposed approximately 180 degrees apart around the circumference. The suction source outlet 226 opens transverse to the suction source axis 142 such that air travels through the suction source outlet 226 radially outwardly. In the illustrated embodiment, substantially all the air traveling through the suction source 54 travels through the suction source outlet 226 radially outwardly into the housing 50. In operation, the working air path 58 through the housing 50 enters the suction source inlet 218, passes through the impeller 217 and the motor 215 to the motor air exit 224 entering the inner chamber 220 adjacent the second end 214. The working air path 58 turns toward the first end 210 and passes from the second portion 223 to the first portion 221 and through the suction source outlet 226 into the housing 50.

Figure 7A:
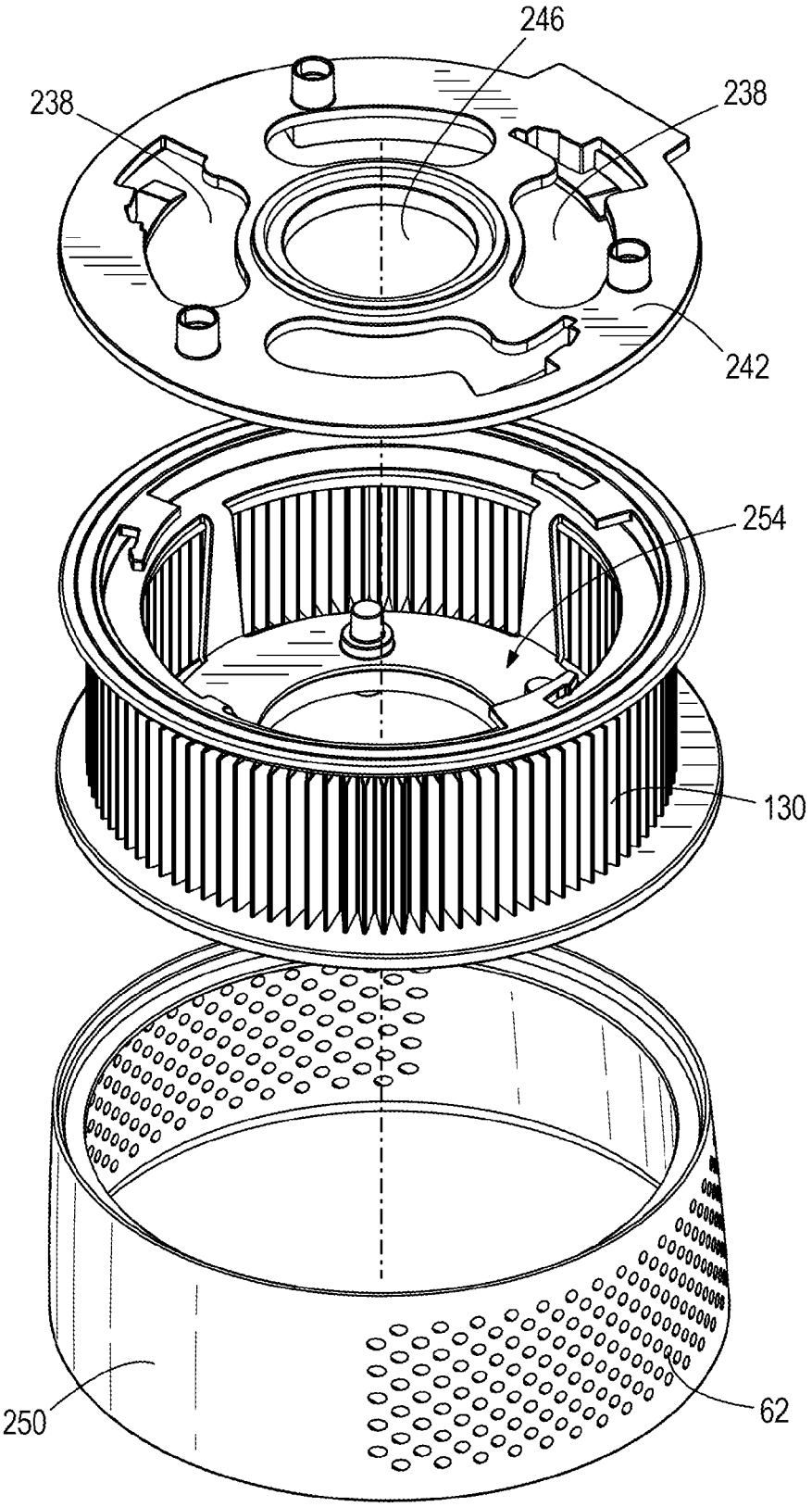
FIG. 7A is an exploded view of a filter housing of the vacuum cleaner of FIG. 2.
Figure 7B:
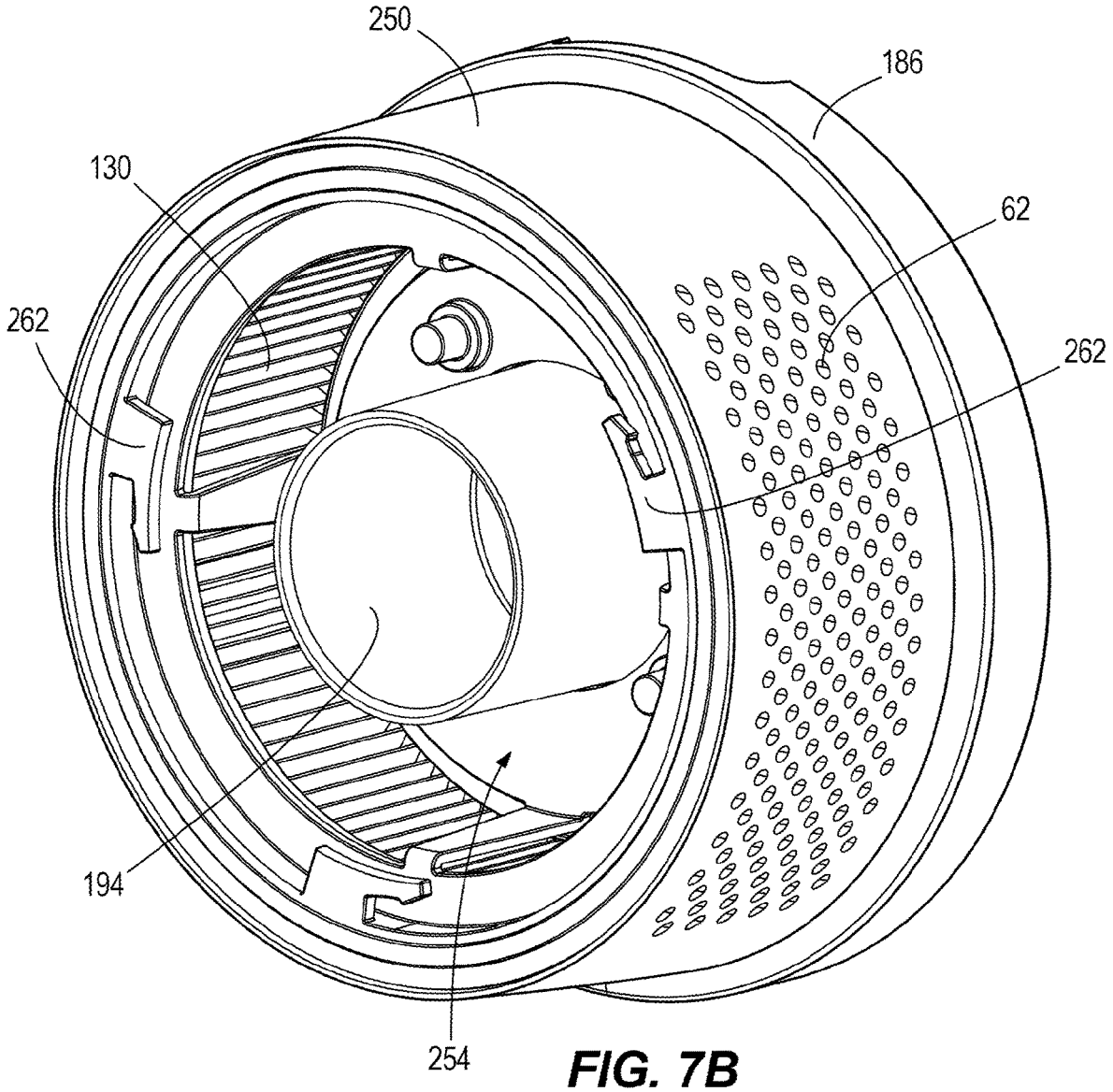
FIG. 7B is a perspective view of a filter housing of the vacuum cleaner of FIG. 2 in a removed state.

With reference to FIGS. 6 and 7A, the housing 50 defines a chamber 230. The suction source 54 is positioned in the chamber 230 so that a second passageway 234 is defined between the housing 50 and the suction source 54. The suction source outlet 226 is configured to exhaust air into the second passageway 234. The housing 50 includes a housing outlet 238 allowing air to exit the housing 50 and continue to the air outlet 62. In the illustrated embodiment, the housing outlet 238 is a plurality of arcuate slots extending around the suction source 54. The housing outlet 238 (also referred to herein as the housing outlet aperture 238) is formed in a front plate 242 of the chamber 230 of the housing 50 adjacent the first end 210 of the suction source 54. The suction source outlet 226 is rearward of the housing outlet 238. As such, the working air exits the suction source outlet 226 radially into the housing 50 and travels forward toward the housing outlet 238.

The front plate 242 includes a central opening 246 in fluid communication with the suction source inlet 218. The central opening 246 is configured to connect the annular wall 190 of the cover 186 to the suction source inlet 218. The housing outlet 238 opens along the longitudinal axis 30. The working air path 58 extends through the housing outlet 238 axially in a forward direction.

With continued reference to FIGS. 6 and 7A, the housing 50 includes a post-motor filter housing 250 formed forward of the front plate 242 of the chamber 230. The post-motor filter housing 250 is annular and includes the air outlet 62. The post-motor filter 130 is removably positioned in the post-motor filter housing 250 in fluid communication with the suction source outlet 226 and the air outlet 62. In the illustrated embodiment, the air outlet 62 is formed as a plurality of openings extending through the post-motor filter housing 250 transverse to the longitudinal axis 30. The working air path 58 (FIG. 3) extends through the air outlet 62 generally radially outwardly. In one embodiment, the working air path 58 (FIG. 3) extends through the air outlet 62 in a forward direction making an acute angle to the longitudinal axis 30 from the side of the separator 98 between 45 and 90 degrees. The post-motor filter 130 includes an aperture 254 extending therethrough. The aperture 254 extends along the longitudinal axis 30. In the illustrated embodiment, the post-motor filter 130 is an annular pleated filter and the aperture 254 extends through the center of the post-motor filter 130. In other embodiments, other types of filters may be used. When the cover 186 is coupled to the body 26, the first passageway 194 extends through the aperture 254 of the post-motor filter 130 connecting the separator 98 and the suction source inlet 218. A third passageway 258 extends between the housing outlet 238 and the air outlet 62. The third passageway 258 is annular around the annular wall 190 of the first passageway 194. The working air path 58 passes radially outward from the third passageway 258 through the post-motor filter 130. The cover 186 forms a forward boundary of the third passageway 258 and the annular wall 190 of the first passageway 194 forms a boundary of the third passageway 258 within the post-motor filter housing 250.

In one embodiment, as shown in FIG. 7B, the cover 186, the post-motor filter 130, and the post-motor filter housing 250 are coupled together and removable from the housing 50 as a unit. In the illustrated embodiment, latching features 262 releasably engage corresponding features on the front plate 242 to couple the filter unit to the housing 50.

Returning to FIG. 3, in operation, power is supplied from the battery 94 to the suction source 54. The suction source 54 then operates, generating an airflow along the working air path 58, as illustrated by the block arrows. The working air path 58 extends from the suction inlet 46 at the front end 34 of the body 26, along the inlet nozzle 42 to the tangential inlet 110. The working air path 58 then rotates around the separator axis 114 through the first cyclone 150 depositing debris in the first collecting region 162, and travels through the plurality of second cyclones 154, depositing fine dust in the second collecting region 166. The working air path 58 extends from the plurality of second cyclones 154 through the pre-motor filter 126 to the cover 186, where air is channeled into the first passageway 194. The working air path 58 travels rearward through the first passageway 194 toward the suction source inlet 218. After traveling through the suction source 54, the working air path 58 extends radially outwardly through the suction source outlet 226. The working air path 58 then extends along the second passageway 234 axially forwardly toward the front plate 242. The working air path 58 extends axially through the housing outlet 238 to the post-motor filter housing 250. The working air path 58 follows the third passageway 258 from the housing outlet 238, radially outwardly through the post-motor filter 130, and finally radially outwardly through the air outlet 62.

Figure 8:
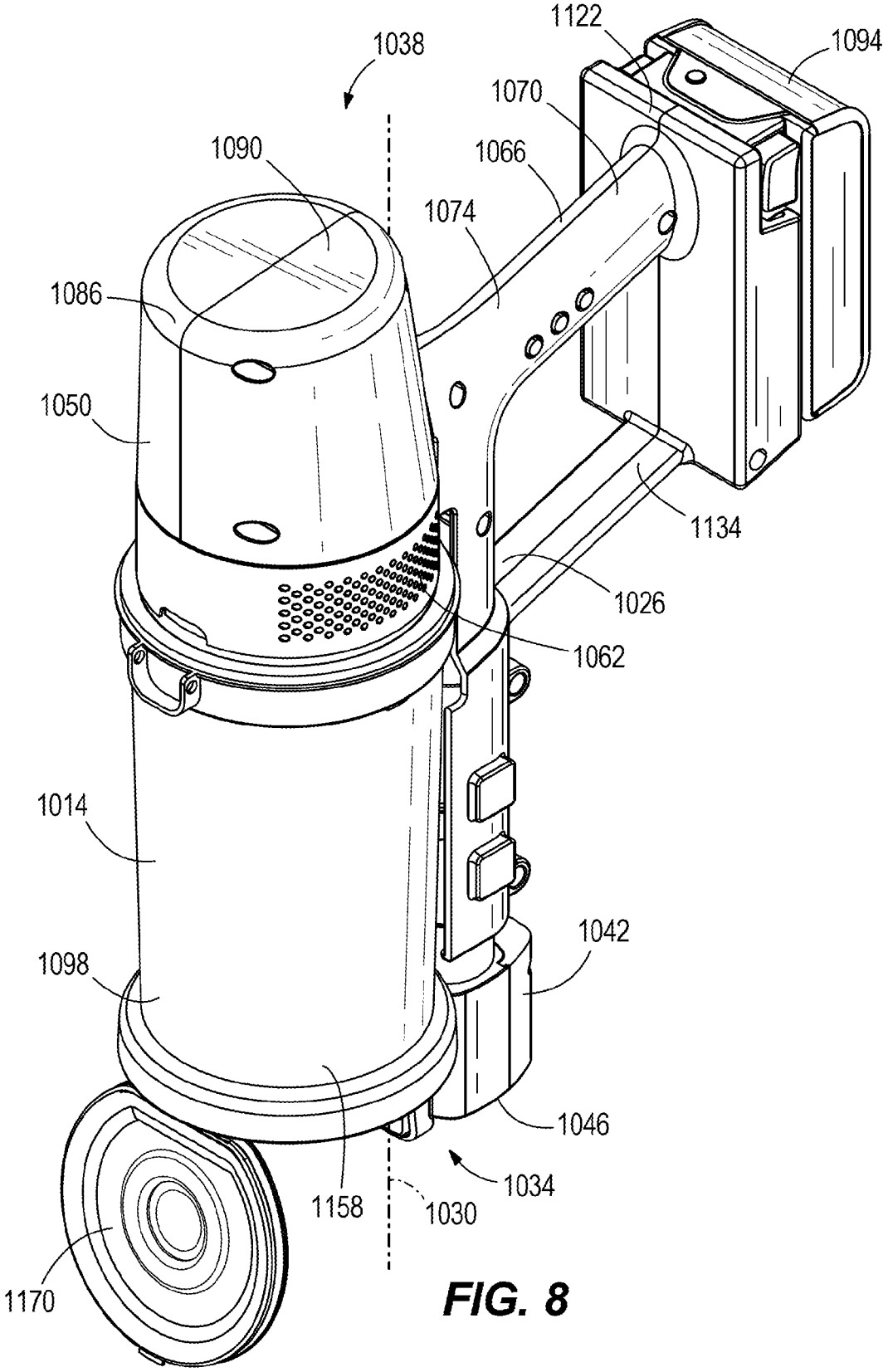
FIG. 8 is a perspective view of another embodiment of a vacuum cleaner.

FIGS. 8-13 illustrates another embodiment of a vacuum cleaner 1014. The vacuum cleaner 1014 is similar to the vacuum cleaner 14, and only differences between the embodiments are described herein. Like parts are labeled and discussed with like reference numbers plus '1000.' As seen in FIG. 8, the vacuum cleaner 1014 includes a body 1026 extending along a longitudinal axis 1030 between a front end 1034 and a rear end 1038. A separator 1098 is coupled to the body 1026 and includes a cover 1170 movably coupled to a front of the separator 1098. In FIG. 8, the cover 1170 is illustrated in the open position, in which debris in a debris collecting chamber 1158 is removable from the separator 98. The housing 1050 includes a rearward surface 1086 with a display 1090. The vacuum cleaner 1014 includes an inlet nozzle 1042 with a suction inlet 1046 and includes an air outlet 1062. A handle 1066 with a grip portion 1070 extends between a first end 1074, coupled to the body 1026, and a second end 1122 adjacent a battery 1094. A secondary support 1134 provides stability to the battery 1094.

Figure 9:
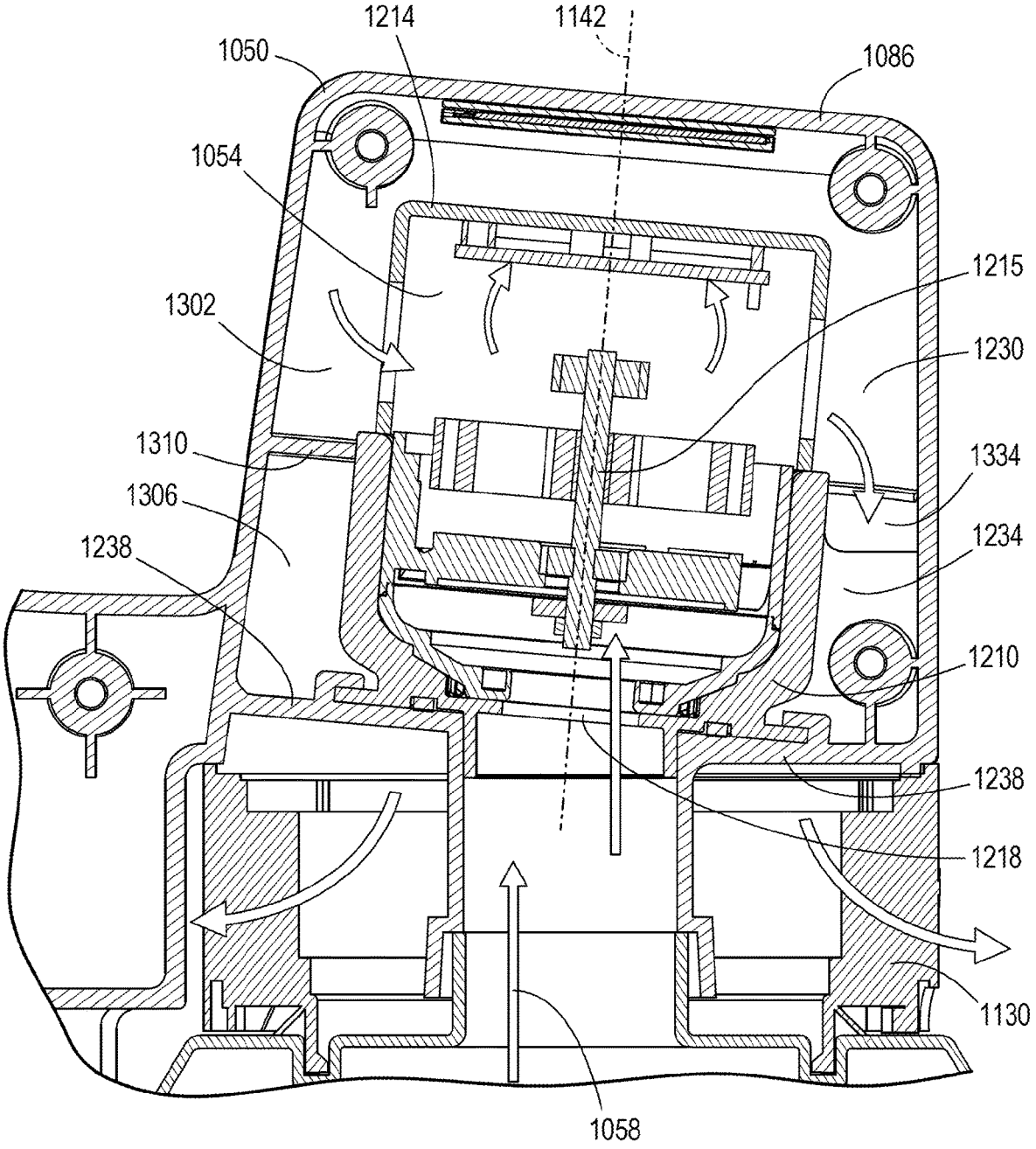
FIG. 9 is a cross sectional view of the rear of the vacuum cleaner of FIG. 8, including a housing.
Figure 10:
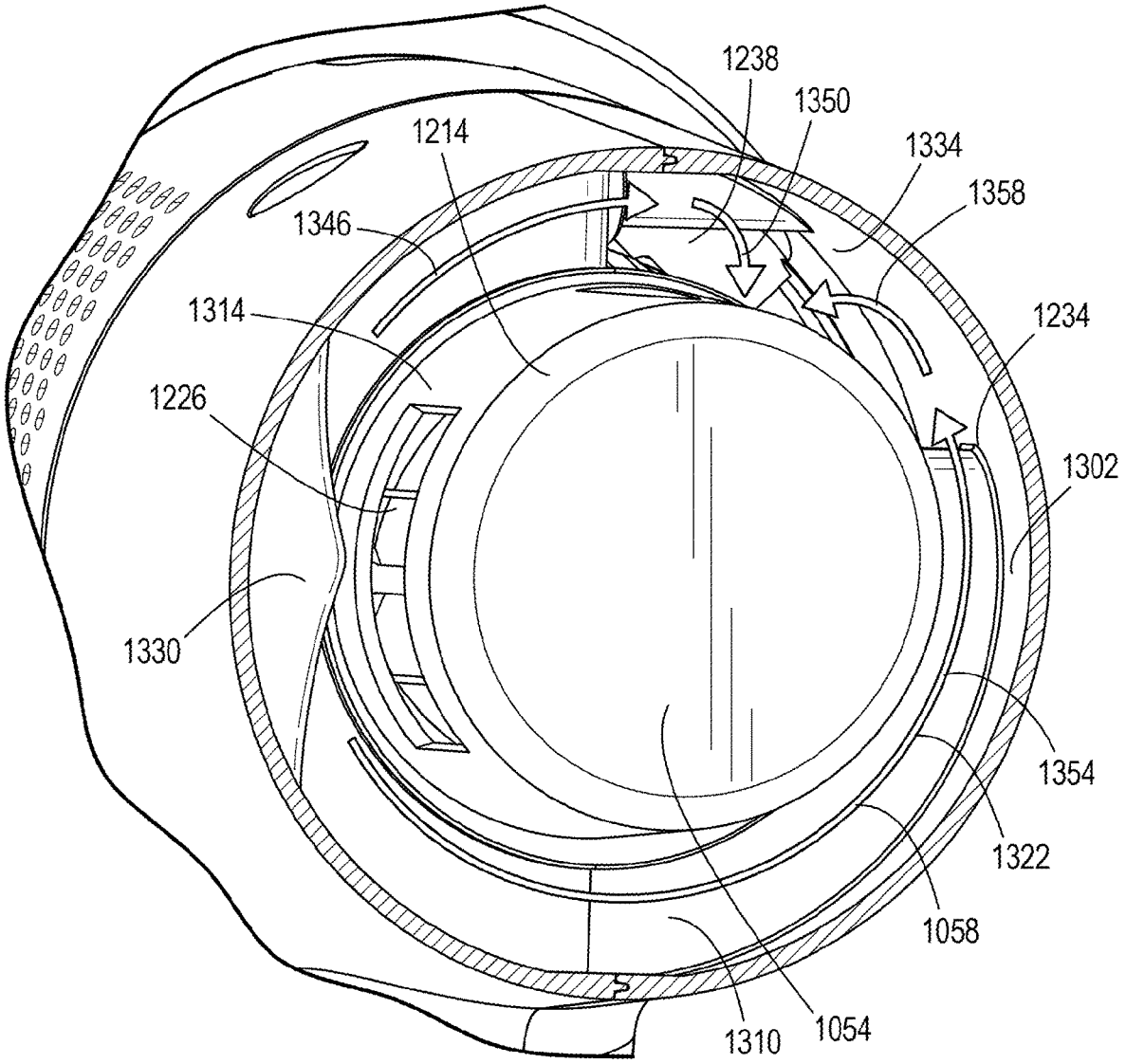
FIG. 10 is a rear perspective view of the vacuum cleaner of FIG. 8, with a rear surface of the housing removed.

With reference to FIG. 9, the housing 1050 defines a chamber 1230. A suction source 1054 is positioned in the chamber 1230. The chamber 1230 is divided into a first chamber 1302 (or rear chamber 1302) and a second chamber 1306 (or a front chamber 1306) by a partition wall 1310 extending transverse to a suction source axis 1142. The suction source 1054 extends along the suction source axis 1142 between a first end 1210 and a second end 1214. The first end 1210 is positioned in the second chamber 1306 and includes a suction source inlet 1218 that is in fluid communication with the separator 1098. The second end 1214 is positioned in the first chamber 1302. A suction source outlet 1226 (FIG. 10) is positioned adjacent the second end 1214 in the first chamber 1302. In the illustrated embodiment, the suction source outlet 1226 is a single aperture located on a side of the suction source 1054. Air travels radially outwardly through the suction source outlet 1226 to a second passageway 1234, which extends from the suction source outlet 1226 in the first chamber 1302 to a housing outlet 1238 in the second chamber 1306. The housing outlet 1238 is positioned adjacent the first end 1210 of the suction source 1054 in the second chamber 1306 in fluid communication with a post-motor filter 1130 downstream of the housing outlet 1238.

Figure 11:
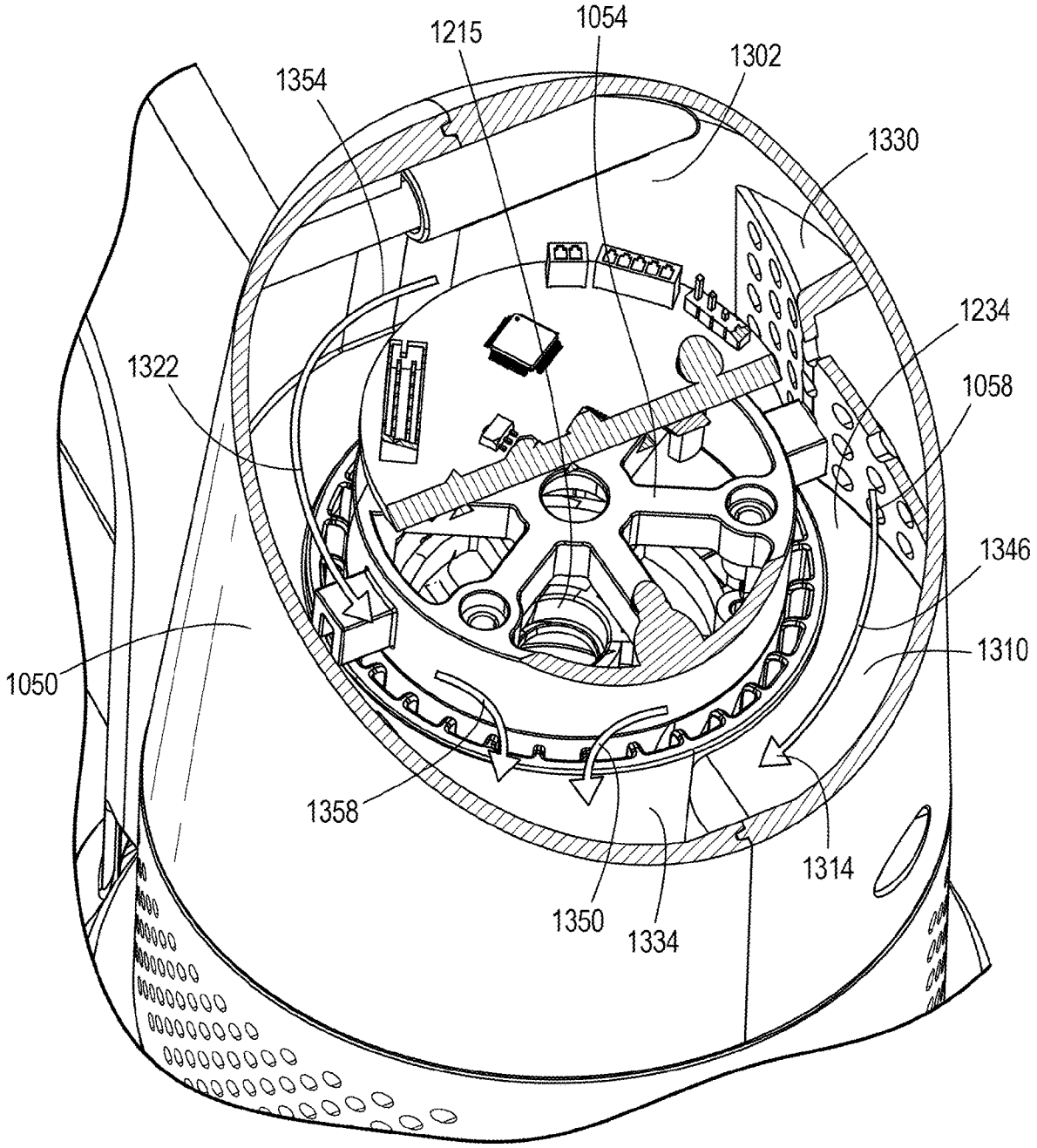
FIG. 11 is a perspective view of the vacuum cleaner of FIG. 8, with portions of the housing removed, and an outer housing of a suction source removed.

With reference to FIGS. 10-12B, the second passageway 1234 includes a portion in the first chamber 1302 divided into a first airflow path 1314 extending from the suction source outlet 1226 circumferentially around the suction source 1054 in a first direction, and a second airflow path 1322 extending from the suction source outlet 1226 circumferentially around the suction source 1054 in a second direction, opposite the first direction. Optionally, a diverter 1330 is mounted in the housing 1050 adjacent the suction source outlet 1226. Air traveling along the flow path through the suction source outlet 1226 impinges on the diverter 1330. The diverter 1330 reduces the turbulence in the air flow and separates the flow path into the first airflow path 1314 and the second airflow path 1322. As seen in FIG. 11, the diverter 1330 may include a plurality of apertures, or other features. In one embodiment, a resilient elastomeric or foam material is disposed beneath the diverter 1330 covering the plurality of apertures from the underside, to assist in reducing the turbulence and reducing the sound of the air flow. In another embodiment, the diverter 1330 is made of a resilient elastomeric or foam material to absorb sound pressure of the airstream coming out of the suction source outlet 1226.

Figure 12A:
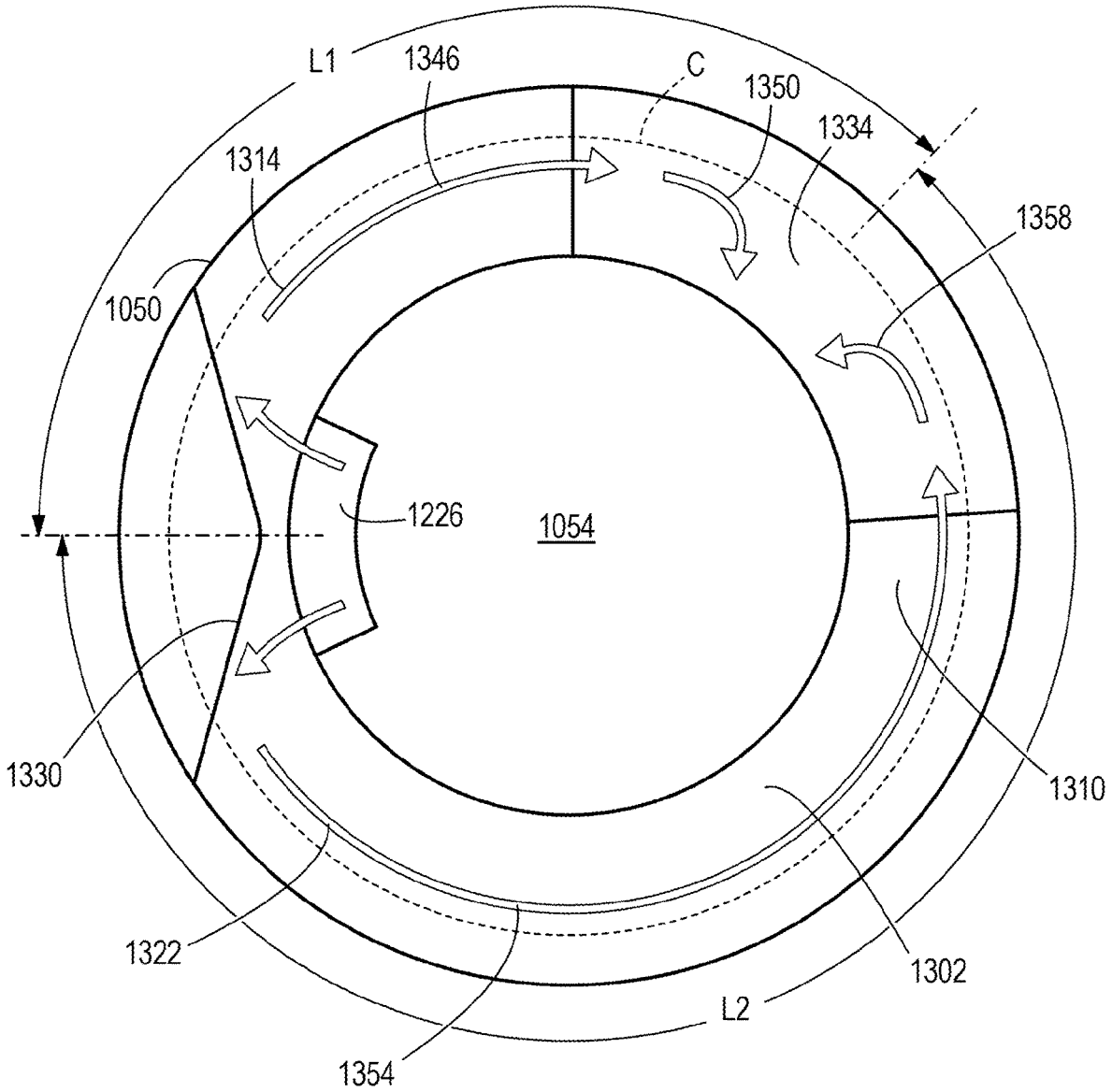
FIG. 12A illustrates a schematic representation of the flow path through the housing of the vacuum cleaner of FIG. 8.

The second chamber 1306 is in fluid communication with the first chamber 1302 through a chamber outlet 1334. The chamber outlet 1334 is formed as an opening in the partition wall 1310. As seen in FIG. 12A, the chamber outlet 1334 is disposed asymmetrically relative to the suction source outlet 1226, such that the first airflow path 1314 extends to a first length L1 and the second airflow path 1322 extends to a second length L2 that is different from the first length L1. The first length L1 is measured circumferentially from a center of the suction source outlet 1226 to a center of the chamber outlet 1334 along the first airflow path 1314 in the first direction. The second length L2 is measured circumferentially from a center of the suction source outlet 1226 to a center of the chamber outlet 1334 along the second airflow path 1322 in the second direction. In the illustrated embodiment, the first length L1 is less than the second length L2. The first airflow path 1314 and the second airflow path 1322 extend generally along a circular path having a circumference C.

Figure 12B:
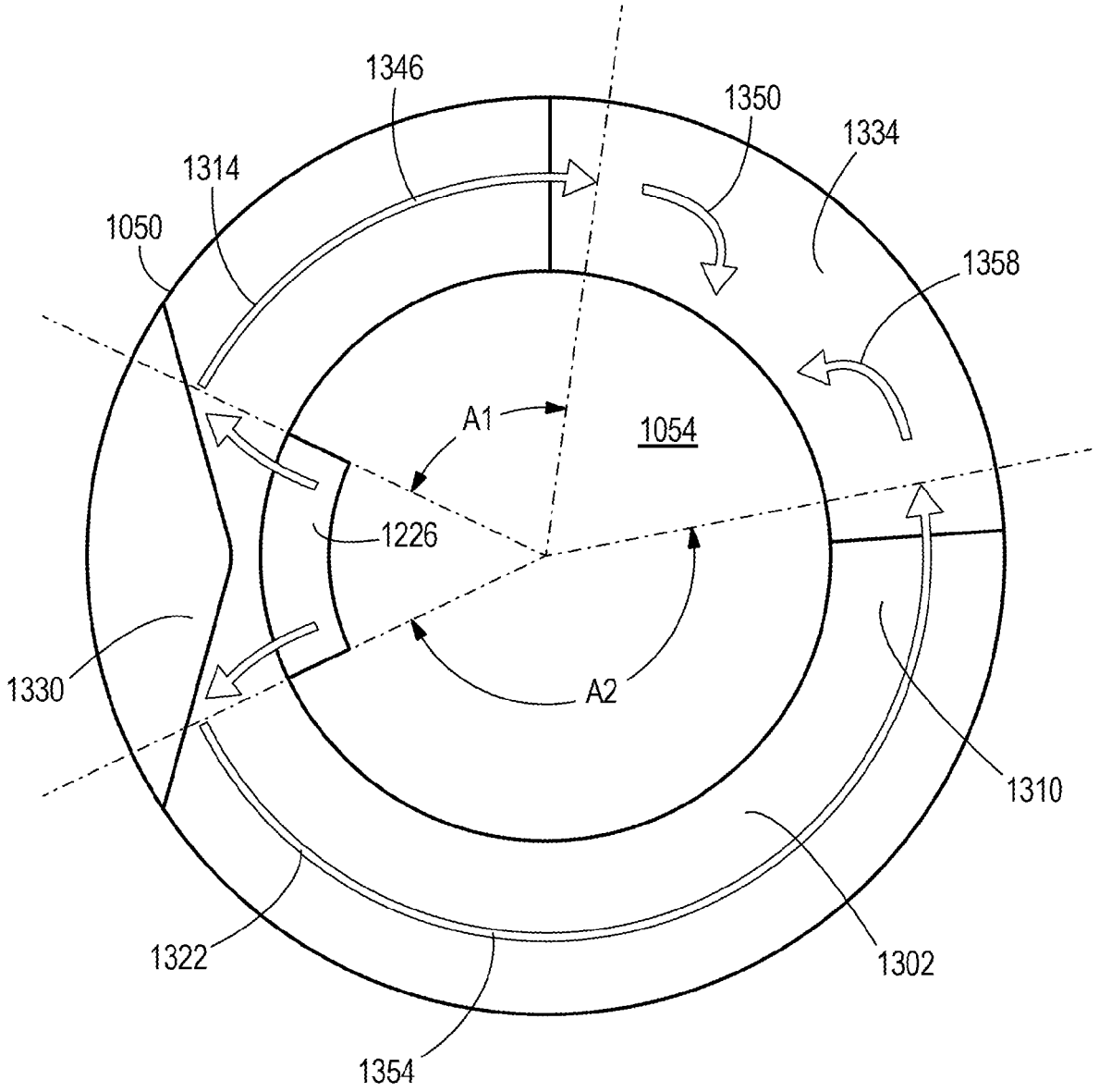
FIG. 12B illustrates a schematic representation of the flow path through the housing of the vacuum cleaner of FIG. 8.

With reference to FIGS. 11 and 12B, the first airflow path 1314 includes a first circumferential component 1346 and a first axial component 1350 as the working air path 1058 moves toward the chamber outlet 1334. In some embodiments, the first circumferential component 1346 extends around the suction source 1054 in the first direction between 80 degrees and 175 degrees, and may be between 110 and 145 degrees. The second airflow path 1322 includes a second circumferential component 1354 and a second axial component 1358 as the working air path 1058 moves toward the chamber outlet 1334. In some embodiments, the second circumferential component 1354 extends around the suction source 1054 in the second direction between 185 and 280 degrees, and may be between 215 and 250 degrees. In some embodiments, the circumferential components 1346, 1354 combine, e.g. L1+L2, to extend between 330 and 360 degrees around the suction source 1054. The first airflow path 1314 and the second airflow path 1322 converge at the chamber outlet 1334. The first axial component 1350 and the second axial component 1358 extend forwardly through the chamber outlet 1334 together. The second passageway 1234 then continues through the second chamber 1306 and forwardly to the housing outlet 1238.

The suction source 1054 includes an electric motor 1215. During operation of the suction source 1054, the motor 1215 operation can include a harmonic frequency that generates an undesirable audible noise. In some embodiments, the harmonic frequency is between 1800 hertz (Hz) and 3100 Hz. In other embodiments, the harmonic frequency is lower than 1800 Hz, or higher than 3100 Hz. The harmonic frequency has a wavelength λ. The harmonic frequency may be a first harmonic, a second harmonic, or a third or higher harmonic. The audible noise generated by the motor 1215 at the harmonics is often undesirable to a user. In order to decrease the audible noise, the lengths L1, L2 are selected to decrease the audible noise of the targeted or predetermined harmonic frequency. In one embodiment, the audible noise was decreased by nearly 10 decibels.

The lengths L1, L2 are selected such that a difference between the lengths is equal to between 40% and 60% of the wavelength of the targeted harmonic frequency, and may be between 45% and 55%. In one embodiment, the difference is half the wavelength of the harmonic frequency. When the difference is 50%, expressed in formulaic form: $L2-L1=0.5\lambda$. Additionally, the second length L2 can be determined by calculating half the sum of half the wavelength λ and the circumference C, where L1, L2, λ, and C have the same unit of length, e.g., millimeters. Expressed in formulaic form: $L2=0.5\ (0.5\lambda+C)$. It should be understood that in other embodiments, the chamber outlet 1334 and/or the suction source outlet 1226 could be positioned such that the first length L1 is greater than the second length L2 in the same proportions as described herein.

By setting the lengths L1, L2 of the airflow paths 1314, 1322 to these values, the harmonic frequency generated by the motor 1215 is subject to decreased audible noise.

Various features and advantages of the invention are set forth in the following claims.

What is claimed is:

1. A vacuum cleaner comprising:

a body having a front end and a rear end and a longitudinal axis extending between the front end and the rear end, the longitudinal axis defining forward and rearward directions;

a suction inlet adjacent the front end, the suction inlet forms an inlet axis extending generally along the longitudinal axis in the forward and rearward directions;

a fluid flow path extending from the suction inlet to an air outlet;

a suction source disposed in the body and operable to generate an airflow along the fluid flow path, the suction source configured to draw air and debris through the suction inlet, the suction source having a suction source inlet and a suction source outlet, the suction source further including a motor and an impeller, the motor operable to rotate the impeller about a suction source axis, the suction source axis extending in the forward and rearward directions partially along the longitudinal axis, and the suction source has a first end, a second end, and the suction source axis extends between the first end and the second end, the suction source inlet is disposed on the first end;

a separator disposed in the fluid flow path between the suction inlet and the suction source inlet, the separator configured to separate debris from the air drawn through the suction inlet, the separator including a cyclonic separator having a separator axis about which the airflow rotates, the separator axis extending in the forward and rearward directions along the longitudinal axis, the separator includes a cover door for emptying the separator, the cover door is movable between a closed position and an open position when the separator is both attached to the body and in fluid communication with the suction inlet;

a post-motor filter disposed in the fluid flow path between the suction source outlet and the air outlet, wherein the post-motor filter includes a filter media that is forward of the first end and the suction source inlet and the filter media is between the suction source and the separator in a direction along the longitudinal axis; and a first passageway extending from the separator to the suction source inlet, the first passageway extending through an aperture of the post-motor filter.

2. The vacuum cleaner of claim 1, wherein the body includes a housing surrounding the suction source, the housing having a housing outlet aperture along the fluid flow path in fluid communication with the air outlet, and wherein a second passageway is formed between the suction source and the housing, between the suction source outlet and the housing outlet aperture.

3. The vacuum cleaner of claim 2, further comprising:

wherein the housing is divided into a first chamber and a second chamber connected by a chamber outlet;

wherein the suction source outlet is disposed in the housing and is configured to direct air in the second passageway in a first airflow path and a second airflow path;

wherein the first airflow path extends circumferentially in a first direction around the suction source to the chamber outlet, and the second airflow path extends circumferentially in a second direction around the suction source to the chamber outlet;

wherein the suction source outlet and the chamber outlet are disposed such that a length of the first airflow path is different than a length of the second airflow path; and wherein the first airflow path and the second airflow path converge at the chamber outlet.

4. The vacuum cleaner of claim 3, wherein the length of the first airflow path is measured from a center of the suction source outlet to a center of the chamber outlet along the first airflow path, and wherein the length of the second airflow path is measured from the center of the suction source outlet to the center of the chamber outlet along the second airflow path.

5. The vacuum cleaner according to claim 3, wherein the first airflow path has a first circumferential component extending circumferentially around the suction source in the first direction.

6. The vacuum cleaner according to claim 5, wherein the second airflow path has a second circumferential component extending circumferentially around the suction source in the second direction, wherein the first circumferential component extends between 80 and 175 degrees in the first direction around the suction source, and wherein the second circumferential component extends between 185 and 280 degrees in the second direction around the suction source.

7. The vacuum cleaner according to claim 6, wherein the first circumferential component and the second circumferential component together extend between 330 and 360 degrees around the suction source.

8. The vacuum cleaner according to claim 3, wherein the first airflow path includes a first axial component that extends axially through the chamber outlet.

9. The vacuum cleaner according to claim 3, wherein the second airflow path has a second circumferential component extending circumferentially around the suction source in the second direction.

10. The vacuum cleaner according to claim 3, wherein the second airflow path includes a second axial component that extends axially through the chamber outlet.

11. The vacuum cleaner according to claim 3, wherein the second direction is opposite the first direction.

12. The vacuum cleaner according to claim 3, wherein the length of the first airflow path and the length of the second airflow path are selected to reduce audible noise caused by a predetermined harmonic frequency.

13. The vacuum cleaner according to claim 3, wherein the difference between the length of the second airflow path and the length of the first airflow path is between 40% and 60% of a wavelength of a harmonic frequency of the motor.

14. The vacuum cleaner according to claim 13, wherein the harmonic frequency of the motor is one selected from the group consisting of: a first harmonic; a second harmonic; and a third harmonic.

15. The vacuum cleaner according to claim 3, wherein a difference between the length of the second airflow path and the length of the first airflow path is half of a wavelength of a harmonic frequency of the motor.

16. The vacuum cleaner according to claim 3, wherein the length of the second airflow path is equal to half of a sum of half a wavelength and a circumference.

17. The vacuum cleaner according to claim 2, wherein the housing outlet aperture is adjacent the first end of the suction source.

18. The vacuum cleaner according to claim 2, wherein the suction source is coaxial with the housing.

19. The vacuum cleaner according to claim 2, wherein the fluid flow path extends through the housing outlet aperture in the forward direction.

20. The vacuum cleaner according to claim 2, wherein the suction source outlet is rearward of the housing outlet aperture.

21. The vacuum cleaner according to claim 2, wherein the fluid flow path extends through the housing outlet aperture parallel to the suction source axis.

22. The vacuum cleaner according to claim 2, wherein the second passageway extends axially from the suction source outlet to the housing outlet aperture.

23. The vacuum cleaner according to claim 2, further comprising a third passageway extending from the housing outlet aperture to the air outlet.

24. The vacuum cleaner according to claim 23, wherein the housing includes a post-motor filter housing for removably receiving the post-motor filter, wherein the first passageway forms a boundary of the third passageway within the post-motor filter housing.

25. The vacuum cleaner according to claim 23, wherein the fluid flow path extends radially outwardly through the third passageway.

26. The vacuum cleaner according to claim 23, wherein the third passageway is annular, and the fluid flow path extends radially outward through the air outlet.

27. The vacuum cleaner according to claim 2, wherein the housing includes a rearward surface including a user interface.

28. The vacuum cleaner according to claim 1, wherein the suction source outlet is adjacent the second end.

29. The vacuum cleaner according to claim 1, wherein the suction source axis is generally parallel to the longitudinal axis.

30. The vacuum cleaner according to claim 1, wherein the fluid flow path extends through the suction source outlet generally radially.

31. The vacuum cleaner according to claim 1, wherein the suction source outlet is a single aperture.

32. The vacuum cleaner according to claim 1, wherein the suction source outlet includes a plurality of apertures.

33. The vacuum cleaner according to claim 1, wherein the body includes a housing, the vacuum cleaner further comprising a diverter positioned in the housing adjacent the suction source outlet, wherein the fluid flow path through the suction source outlet impinges on the diverter.

34. The vacuum cleaner according to claim 1, wherein the body includes a housing, and wherein the housing includes a post-motor filter housing for removably receiving the post-motor filter.

35. The vacuum cleaner according to claim 34, wherein the post-motor filter housing includes the air outlet.

36. The vacuum cleaner according to claim 1, wherein the post-motor filter is annular, and the aperture extends through a center of the post-motor filter.

37. The vacuum cleaner according to claim 1, wherein the fluid flow path extends radially outward through the post-motor filter.

38. The vacuum cleaner according to claim 1, wherein the fluid flow path extends through the first passageway in the rearward direction.

39. The vacuum cleaner according to claim 1, wherein the separator includes a second cyclonic separator and a debris storage chamber.

40. The vacuum cleaner according to claim 39, wherein the separator includes a pre-motor filter disposed in a pre-motor filter chamber, wherein the pre-motor filter chamber includes an upstream portion in communication with the separator and a downstream portion in communication with the first passageway.

41. The vacuum cleaner according to claim 40, wherein the downstream portion of the pre-motor filter chamber forms a cover releasably coupled to the separator.

42. The vacuum cleaner according to claim 41, wherein the pre-motor filter is removable from the pre-motor filter chamber when the cover is uncoupled from the separator.

43. The vacuum cleaner according to claim 41, wherein the cover forms a forward boundary of a third passageway.

44. The vacuum cleaner according to claim 41, wherein the cover is removable from the body with the separator.

45. The vacuum cleaner according to claim 41, wherein the cover remains coupled to the body when the separator is uncoupled from the body.

46. The vacuum cleaner according to claim 41, wherein the cover is connected to the pre-motor filter when the separator is coupled to the body.

47. The vacuum cleaner according to claim 41, wherein the body includes a housing, and wherein the housing includes a post-motor filter housing for removably receiving the post-motor filter, wherein the cover releasably closes the pre-motor filter chamber and releasably closes the post-motor filter housing when the separator is coupled to the body.

48. The vacuum cleaner according to claim 1, wherein the body includes a housing, and wherein the housing includes a post-motor filter housing for removably receiving the post-motor filter, wherein the separator is releasably coupled to the body, and wherein the post-motor filter is removable from the post-motor filter housing when the separator is uncoupled from the body.

49. The vacuum cleaner according to claim 1, wherein the separator axis is offset from the inlet axis.

50. The vacuum cleaner according to claim 1, further comprising a handle extending along a handle axis between a first end and a second end, the handle including a grip portion defined between the first end and the second end.

51. The vacuum cleaner according to claim 50, wherein the handle axis does not intersect the suction source.

52. The vacuum cleaner according to claim 50, wherein the inlet axis does not intersect the handle.

53. The vacuum cleaner according to claim 50, wherein the handle axis extends through the post-motor filter.

54. The vacuum cleaner according to claim 50, wherein the handle is a pistol-grip style handle.

55. The vacuum cleaner according to claim 50, wherein the suction source is rearward of the handle axis.

56. The vacuum cleaner according to claim 1, further comprising a battery operatively connected to provide power to the suction source.

57. The vacuum cleaner according to claim 56, further comprising a handle extending along a handle axis between a first end and a second end, the handle including a grip portion defined between the first end and the second end, wherein the first end of the handle is coupled to the body and the second end is adjacent the battery.

58. The vacuum cleaner according to claim 57, wherein the handle axis extends through the battery.

59. The vacuum cleaner according to claim 1, wherein the suction source axis is transverse to the separator axis.

60. The vacuum cleaner according to claim 1, wherein the suction source axis forms an acute angle to the separator axis.

61. The vacuum cleaner according to claim 60, wherein the acute angle is less than 15 degrees.

62. The vacuum cleaner according to claim 1, wherein the body includes a housing surrounding the suction source, the vacuum cleaner further comprising a post-motor filter housing for removably receiving the post-motor filter, wherein the post-motor filter housing and the post-motor filter are coupled together and removable from the housing as a unit, and wherein the post-motor filter housing includes an annular wall that forms the first passageway and the annular wall is removable with the post-motor filter housing from the housing.

* * * * *